US006685999B2

(12) United States Patent
Ichinose et al.

(10) Patent No.: US 6,685,999 B2
(45) **Date of Patent: *Feb. 3, 2004**

(54) RECORDING MEDIUM AND METHOD OF MANUFACTURING THE SAME

(75) Inventors: Hirofumi Ichinose, Tokyo (JP); Tsuyoshi Santo, Yokohama (JP); Hiroshi Tomioka, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/472,992

(22) Filed: Dec. 28, 1999

(65) Prior Publication Data

US 2003/0039808 A1 Feb. 27, 2003

(30) Foreign Application Priority Data

Dec. 28, 1998 (JP) ..... 10-373141

(51) Int. Cl.[7] ..... B41M 5/00; B41J 2/01

(52) U.S. Cl. ..... 428/32.25; 347/105; 427/152; 428/32.32; 428/32.35; 428/32.37

(58) Field of Search ..... 428/195, 329, 428/331, 328, 32.25, 32.32, 32.37, 32.35; 427/152; 347/105

(56) References Cited

U.S. PATENT DOCUMENTS

| | | | |
|---|---|---|---|
| 4,202,870 A | 5/1980 | Weber et al. | 423/630 |
| 4,242,271 A | 12/1980 | Weber et al. | 260/448 |
| 4,328,174 A | 5/1982 | Schmidt et al. | 260/930 |
| 4,740,796 A | 4/1988 | Endo et al. | 346/1.1 |
| 4,879,166 A | 11/1989 | Misuda et al. | 428/212 |
| 5,104,730 A | 4/1992 | Misuda et al. | 428/304.4 |
| 5,463,178 A | 10/1995 | Suzuki et al. | 428/216 |

(List continued on next page.)

FOREIGN PATENT DOCUMENTS

| | | |
|---|---|---|
| EP | 0 298 424 | 1/1989 |
| EP | 0 407 720 | 1/1991 |
| EP | 0 634 287 A1 | 1/1995 |

(List continued on next page.)

OTHER PUBLICATIONS

J. Roček, et al., Porous structure of aluminium hydroxide and its content of pseudoboehmite, Applied Catalysis, 74 (1991) pp. 29–36.

*Primary Examiner*—Pamela R. Schwartz
(74) *Attorney, Agent, or Firm*—Fitzpatrick, Cella, Harper & Scinto

(57) ABSTRACT

A recording medium for ink jet printing comprises a base material layer such as paper or plastic sheet, a porous lower layer formed on the base material layer, and a porous upper layer formed on the porous lower layer. The porous lower layer contains hydrated alumina showing a boehmite structure. The porous upper layer mainly comprises agglomerates of spherical silica particles with particle diameters ranging between 1 and 100 nm and a binder and contains voids mainly found between the agglomerates, not within the agglomerates. Preferably, a second type of spherical silica particles having smaller particle diameters than the above first type of spherical silica particles are also contained in the porous upper layer, and in this case, the first type particles have particle diameters ranging between 10 and 100 nm and are mostly found outside the agglomerates, while the second type particles have particle diameters ranging between 1 and 10 nm and are mostly found within the agglomerates. The recording medium provides excellent image qualities even when a large amount of ink is applied at a time in case of high speed printing or different types of ink containing various dyes or pigments are used.

26 Claims, 3 Drawing Sheets

U.S. PATENT DOCUMENTS

| | | | | |
|---|---|---|---|---|
| 5,635,291 | A | 6/1997 | Yoshino et al. | 428/304.4 |
| 5,679,451 | A | 10/1997 | Kondo et al. | 428/304.4 |
| 5,707,716 | A | 1/1998 | Yoshino et al. | 428/212 |
| 5,738,932 | A | 4/1998 | Kondo et al. | 428/195 |
| 5,800,916 | A | 9/1998 | Yoshino et al. | 428/328 |
| 5,804,320 | A | 9/1998 | Tomioka et al. | 428/478.2 |
| 5,912,071 | A | 6/1999 | Takeshita et al. | 428/304.4 |
| 5,952,051 | A | 9/1999 | Asano et al. | 427/362 |
| 5,955,142 | A * | 9/1999 | Yoshino et al. | |
| 5,955,185 | A | 9/1999 | Yoshino et al. | 428/304.4 |
| 5,965,252 | A | 10/1999 | Santo et al. | 428/329 |
| 5,989,378 | A | 11/1999 | Liu et al. | 156/241 |
| 6,187,419 | B1 * | 2/2001 | Kijimuta et al. | |

FOREIGN PATENT DOCUMENTS

| | | |
|---|---|---|
| EP | 0 701 904 | 3/1996 |
| EP | 0 705 710 A1 | 4/1996 |
| EP | 0 736 392 | 10/1996 |
| EP | 0 803 374 | 10/1997 |
| JP | 52-53012 | 4/1977 |
| JP | 53-49113 | 5/1978 |
| JP | 54-59936 | 5/1979 |
| JP | 55-51583 | 4/1980 |
| JP | 55-144172 | 11/1980 |
| JP | 55-146786 | 11/1980 |
| JP | 56-5830 | 1/1981 |
| JP | 1-97678 | 4/1989 |
| JP | 2-276670 | 11/1990 |
| JP | 2-276671 | 11/1990 |
| JP | 3-215082 | 9/1991 |
| JP | 3-281383 | 12/1991 |
| JP | 4-115984 | 4/1992 |
| JP | 4-115985 | 4/1992 |
| JP | 5-16015 | 1/1993 |
| JP | 5-323037 | 12/1993 |
| JP | 6-18131 | 1/1994 |
| JP | 6-48016 | 2/1994 |
| JP | 6-55829 | 3/1994 |
| JP | 7-2430 | 1/1995 |
| JP | 7-76162 | 3/1995 |
| JP | 7-89220 | 4/1995 |
| JP | 7-89221 | 4/1995 |
| JP | 7-101142 | 4/1995 |
| JP | 7-117335 | 5/1995 |
| JP | 7-172038 | 7/1995 |
| JP | 7-232473 | 9/1995 |
| JP | 7-232474 | 9/1995 |
| JP | 7-232475 | 9/1995 |
| JP | 8-132731 | 5/1996 |
| JP | 8-174993 | 7/1996 |
| JP | 8-325992 | 12/1996 |
| JP | 9-66664 | 3/1997 |
| JP | 9-76628 | 3/1997 |
| JP | 9-86035 | 3/1997 |
| JP | 9-99627 | 4/1997 |
| JP | 9-150571 | 6/1997 |
| JP | 9-175000 | 7/1997 |
| JP | 9-183267 | 7/1997 |
| JP | 2714350 | 10/1997 |
| JP | 2714352 | 10/1997 |
| JP | 9-286165 | 11/1997 |
| JP | 10-71764 | 3/1998 |
| JP | 10-94754 | 4/1998 |
| JP | 10-166715 | 6/1998 |

* cited by examiner

RECORDING MEDIUM AND METHOD OF MANUFACTURING THE SAME

BACKGROUND OF THE INVENTION

1. Field of the Invention

This invention relates to a recording medium to be suitably used with water-based ink for recording and a method of manufacturing the same. More particularly, the present invention relates to a recording medium particularly adapted to ink-jet recording with the effects of a high optical density of images, sharp tones, a gradation of a large number of stages, freedom from changes of tint and any noticeable beading phenomena and an excellent ink-absorption capacity when used for printing at high speed with any of various different types of ink including ink showing different densities, an ink set of three or more than three different densities, ink to be mostly used for solid images, ink of a mixture of pigments/dyes or a combination of pigment ink and dye ink and also to a method of manufacturing such a recording medium.

2. Related Background Art

The ink-jet recording system is a system of causing micro-droplets of ink to fly and adhere to a recording medium such as a sheet of paper for recording images and/or characters on the basis of a selected principle of operation. It provides a number of advantages including high speed/low noise printing, ease of multi-color printing, versatility of patterns that can be recorded and elimination of development and fixation processes. Hence, it has been popularly used in various recording apparatus, particularly in the field of information-related equipment, and the demand for such systems has been expanding rapidly. Additionally, images formed by the multi-color ink-jet recording system are comparable to those produced by multi-color plate printing and color phototypesetting in terms of image quality, and are less costly than ordinary multi-color printing and printing of other types so that the multi-color ink-jet recording system is broadening the scope of application to include full color image recording.

While a number of improvements have been realized for recording apparatus and recording methods employing a multi-color ink-jet recording system to keep pace with the recent developments of recording technologies particularly in terms of high speed recording, high definition recording and full-color recording, sophisticated technological requirements have also been placed for the recording medium.

In an attempt to meet such technological requirements, various forms of recording mediums have been proposed to date.

For instance, Japanese Patent Application Laid-Open No. 52-53012 discloses ink-jet recording paper prepared by causing a surface processing paint to permeate into low sized base paper. Japanese Patent Application Laid-Open No. 53-49113 discloses ink-jet recording paper prepared by impregnating sheets of paper that have been coated with particles of urine-formalin resin with a water-soluble polymeric compound. Japanese Patent Application Laid-Open No. 56-5830 describes ink-jet recording paper comprising an ink absorbing layer formed on the surface of a base material layer by an application process. Japanese Patent Application Laid-Open No. 55-51583 describes the use of amorphous silica as pigment in the coating layer of ink-jet recording paper. Japanese Patent Application Laid-Open No. 55-144172 discloses an image receiving sheet of paper having a layer formed by applying a pigment adapted to absorb the coloring agent of water-based ink. Japanese Patent Application Laid-Open No. 55-146786 discloses the use of a layer of a water-soluble polymeric compound formed by an application process.

Improvements of ink absorption and surface gloss of a paper recording medium also have been proposed in, for example, U.S. Pat. Nos. 4,879,166 and 5,104,730, and Japanese Patent Applications Laid-Open Nos. 2-276670, 3-215082 and 3-281383. Japanese Patent Applications Laid-Open Nos. 7-089221, 7-172038, 7-232473, 7-232474, 7-232475, 8-132731, 8-174993, 9-066664, 9-076628, 9-086035 and 9-099627, of the inventors of the present patent application, propose sheets of recording paper having an ink-receiving layer formed by using hydrated alumina such as pseudo-boehmite.

U.S. Pat. No. 4,879,166, European Patent No. 298,424 and Japanese Patent Applications Laid-Open Nos. 1-97678, 6-48016 and 6-55829 propose a recording medium formed by using both hydrated alumina having a specific absorption ability and silica.

Additionally, the patent documents as listed below propose a two-layered recording medium devised for improving the image quality, the gloss and the surface resistance against scars of recording medium.

(1) U.S. Pat. No. 5,104,730, European Patent No. 407,720, Japanese Patent Applications Laid-Open Nos. 2-276671, 3-281383, 4-115984 and 4-115985 propose a multilayer recording medium having a layer of porous micro-particles of silica formed on a porous alumina layer.

(2) Japanese Patent Application Laid-Open No. 6-18131 proposes a recording medium comprising a first ink-receiving layer formed on a base material layer and a second ink-receiving layer of inorganic micro-particles formed on the first layer and practically not containing any organic polymeric adhesive agent.

(3) U.S. Pat. No. 5,463,178, European Patent No. 634,287 and Japanese Patent Application Laid-Open No. 7-76162 propose a recording medium comprising a porous hydrated alumina layer and a silica gel layer formed thereon.

(4) Japanese Patent Application Laid-Open No. 10-166715 proposes a recording medium comprising a base material layer, an ink-receiving layer of hydrated alumina such as pseudo-boehmite and a silica layer containing non-spherical silica particles.

(5) Japanese Patent Applications Laid-Open Nos. 7-089220, 7-101142 and 7-117335 propose a recording medium comprising upper and lower ink-receiving layers, of which the upper layer is a glossy layer containing colloidal silica as principal ingredient.

(6) Japanese Patent Applications Laid-Open Nos. 9-150571, 9-175000, 9-183267, 9-286165 and 10-71764 propose a recording medium comprising a pair of ink-receiving layers, where the pore distribution and the average particle diameter of the silica particles of the upper layer are limited to respective specific ranges or silica is used in combination with alumina sol or silica alumina for the upper layer.

The above listed patent documents propose improvements of the properties of recording mediums including ink absorptivity, resolution, image density, coloration, color reproducibility, transparence and gloss. Despite the above described improvements and other improvements, a recording medium of the type under consideration faces needs that have arisen, due to the recent technological development in the field of recording apparatus, for high speed printing with a degree of image quality comparable to silver salt photographs. For example, while the recording medium realized by using hydrated alumina or a combination of hydrated alumina and silica as disclosed in U.S. Pat. No. 4,879,166 is excellent in terms of image quality and gloss, it is accompanied by the problem that the surface is apt to be damaged so that the printed surface can easily become scarred depending on the delivery system of the printer. Additionally, the ink absorptivity of the recording medium can be degraded in a hot and humid environment and sheets of the recording medium can stick to each other when stacked for storage in such an environment.

While a recording medium having two ink-receiving layers is proposed in a number of patent documents in order to improve the ink absorptivity and the surface properties, the proposals are accompanied by respective drawbacks as discussed below and hence are not satisfactory.

(1) A multilayer recording medium according to any of U.S. Pat. No. 5,104,730, European Patent No. 407,720, Japanese Patent Applications Laid-Open Nos. 2-276671, 3-281383, 4-115984 and 4-115985 comprises a layer of porous micro-particles of silica formed on a porous alumina layer. The porous alumina layer is intended to absorb the colorant of the ink used for printing, while the silica layer is designed to absorb the solvent of the ink. With this arrangement, although the ink is absorbed well with an excellent coloring effect mainly due to the separated functional roles of the two layers, it is accompanied by the problem that the silica layer becomes white and opaque due to the porous micro-particles of silica of the silica layer.

(2) A recording medium according to Japanese Patent Application Laid-Open No. 6-18131 comprises two ink-receiving layers, of which the surface layer is a layer of inorganic micro-particles formed on the first layer and practically not containing any organic polymeric adhesive agent. While this arrangement provides the advantage that no swelling nor dissolution occurs along the interface of ink and resin due to the ink that comes into contact nor the resin is deformed as a result of printing, it cannot secure a satisfactory level of film strength so that the film can be peeled off and/or damaged when the printer is moved or otherwise handled.

(3) A multilayer recording medium according to any of U.S. Pat. No. 5,463,178, European Patent No. 634,287 and Japanese Patent Application Laid-Open No. 7-76162 comprises a silica gel surface layer. However, since primary silica particles are arranged regularly in the silica gel layer without forming secondary particles, silica particles are filled densely in the layer to eliminate gaps through which the solvent can move, the absorptivity of the recording medium is not remarkably improved by the provision of a silica gel layer on the pseudo-boehmite, porous layer.

(4) A multilayer recording medium according to Japanese Patent Application Laid-Open No. 10-166715 comprises a surface silica layer containing non-spherical silica particles. While this arrangement improve the permeation of ink because particles are filled coarsely there from a microscopic point of view, it is accompanied by the problem of a reduced transparency and a frequent occurrence of cracks due to the use of spherical silica particles.

(5) A multilayer recording medium according to any of Japanese Patent Applications Laid-Open Nos. 7-089220, 7-101142 and 7-117335 comprises upper and lower ink-receiving layers, of which the upper layer is a glossy layer containing colloidal silica as principal ingredient. While this arrangement ensures an enhanced level of surface gloss for the upper ink-receiving layer, it requires the use of a cast molding process to reduce the absorptivity to say nothing of improving the latter. While the proposed recording medium is prepared on the basis of various ingenious arrangements including that of regulating the glass transition temperature of polymeric latex that is also used in the recording medium, that of utilizing colloidal silica composite emulsion and that of reducing the average particle diameter of colloidal silica to less than 300 nm, it cannot prevent the reduction of ink absorptivity because of the use of a cast, although it may be able to alleviate the reduction of porosity to some extent by selecting appropriate operating conditions for the cast.

(6) A multilayer recording medium according to any of Japanese Patent Applications Laid-Open Nos. 9-150571, 9-175000, 9-183267, 9-286165 and 10-71764 comprises a pair of ink-receiving layers, where the pore distribution and the average particle diameter of the silica particles of the upper layer are limited to respective specific ranges, in order to improve both the ink absorptivity and the transparency. However, due of the fact that a wide range is selected for the average particle diameter of the silica particles of the upper layer, it will be difficult to realize a satisfactory level of transparency if the silica particles have large particle diameters or form secondary particles. Additionally, the ink absorptivity of the ink layer may not be sufficient because of difficulties in forming a satisfactorily porous layer if the resin used as adhesive is soluble in water. In short, the recording medium proposed by any of these patent documents cannot provide a level of porosity that ensures both a satisfactory level of transparency and that of absorptivity.

SUMMARY OF THE INVENTION

In view of the above identified problems and other problems of the prior art, it is therefore the object of the present invention to provide a recording medium that is adapted to ink-jet recording with the effects of a high optical density of images, sharp tones, a gradation with a large number of stages, freedom from changes of tint and any noticeable beading phenomena and an excellent ink-absorption capacity as well as a high surface resistance against scars and an enhanced level of transparency when used for printing at high speed with any of various different types of ink including an ink set of three or more than three different densities, ink to be mostly used for solid images, ink of a mixture of pigments/dyes or a combination of pigment ink and dye ink, and also to an image forming method using such a recording medium.

In an aspect of the invention, the above object is achieved by providing a recording medium comprising a base material layer, a porous lower layer containing hydrated alumina showing a boehmite structure and a porous upper layer containing silica, wherein said porous upper layer mainly comprises agglomerates of spherical silica particles with a particle diameter between 1 and 100 nm and a binder and voids and said voids are mainly found between said agglomerates and not within the said agglomerates.

According to the present invention, there is also provided a method of manufacturing a recording medium comprising steps of sequentially laying a porous lower layer containing hydrated alumina showing a boehmite structure and a porous upper layer containing silica on a base material layer, wherein said porous upper layer is formed by applying and drying a dispersive solution prepared by adding alcohol by 30 to 90% to an aqueous dispersive solution containing spherical colloidal silica with an average particle diameter between 1 and 100 nm and at least a type of resin emulsion.

A recording medium according to the invention shows improved surface properties and ink absorptivity. A method of manufacturing a recording medium according to the invention can provide an improved recording medium to be preferably used for ink jet recording. The present invention has been realized as a result of research efforts paid by the inventors of the present invention on the basis of their findings.

DESCRIPTION OF THE PREFERRED EMBODIMENTS

Figure 1:
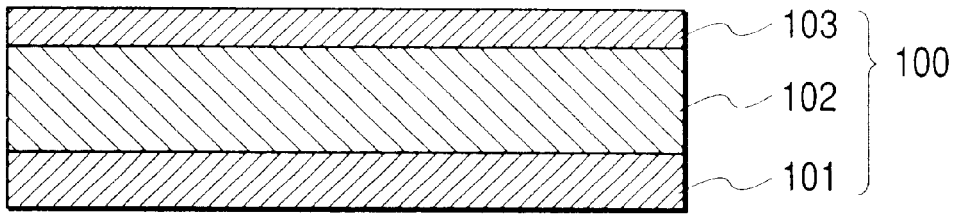
FIG. 1 is a schematic cross sectional view of an embodiment of recording medium according to-the invention.
Figure 2:
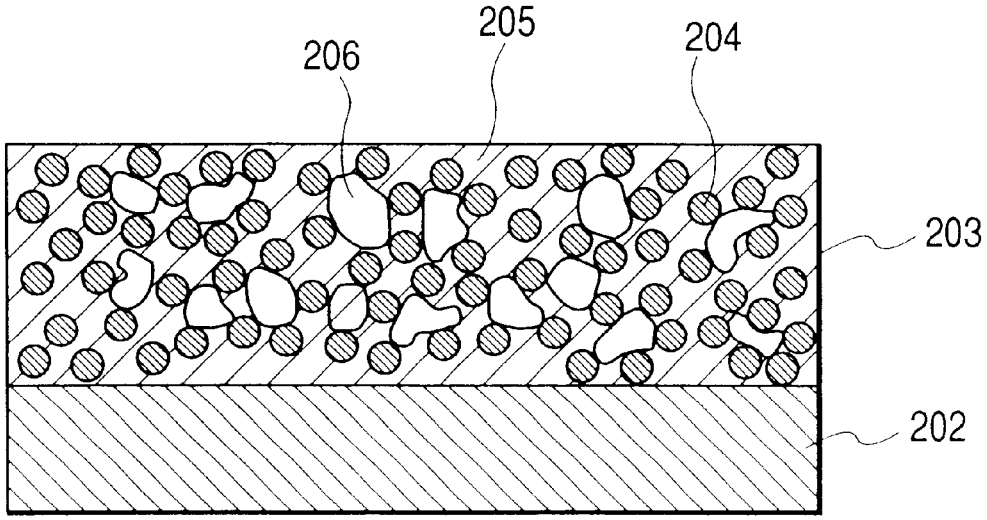
FIG. 2 is an enlarged schematic cross sectional view of the porous upper layer of a recording medium according to the invention (showing particle diameters of a single type of silica particles).
Figure 3:
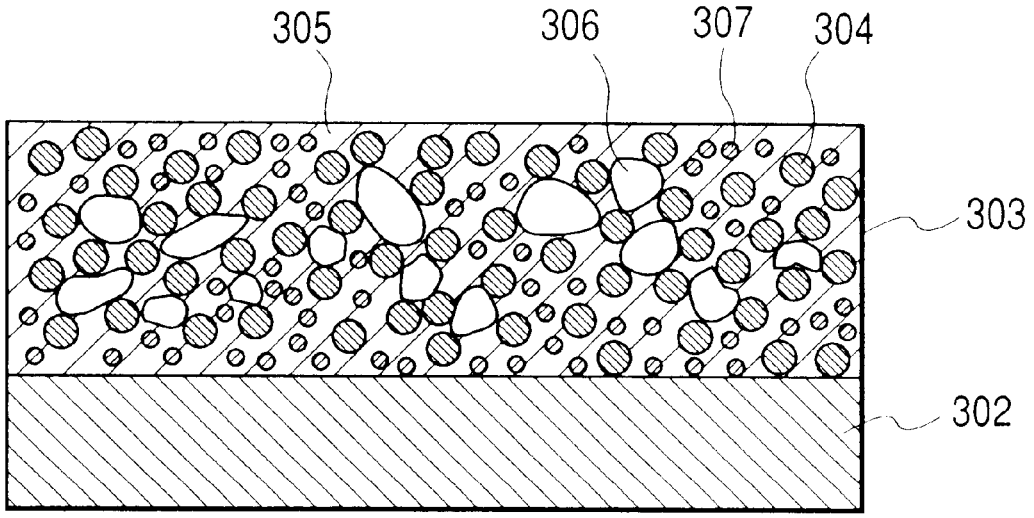
FIG. 3 is an enlarged schematic cross sectional view of the porous upper layer of a recording medium according to the invention (showing particle diameters of two types of silica particles).

FIGS. 1 through 3 are schematic cross sectional views of an embodiment of recording medium according to the invention. In FIG. 1, there are shown a base material layer 101, a porous lower layer 102 and a porous upper layer 103. FIG. 2 is an enlarged schematic cross sectional view of the embodiment of FIG. 1, showing only the porous lower layer and the porous upper layer thereof. In FIG. 2, there are shown the porous lower layer 202, the porous upper layer 203, spherical silica particles 204, binder agent 205 and voids 206. FIG. 3 is also an enlarged schematic cross sectional view of an embodiment obtained by modifying that of FIG. 2 to make the porous upper layer contain two different types of spherical silica particles in terms of size, or large particles and small particles. In FIG. 3, there are shown the porous lower layer 302, the porous upper layer 303, spherical silica particles with a larger diameter 304, binder agent 305, voids 306 and spherical silica particles with a smaller diameter 307.

According to the invention, the porous upper layer 103 is formed on the porous lower layer 102 and contains agglomerates of spherical silica particles and a binder agent and voids therein. Thus, the voids provide paths for ink to improve the absorptivity of the recording medium and make the latter highly adapted to image formation. Additionally, since the porous layer of the recording medium has a two-layered structure, it is possible to assign different functional roles to the two porous layers so as to make the porous lower layer 102 operate as ink absorbing and fixing layer and the porous upper layer 103 operate for controlling the surface properties including the absorptivity and transmissivity of ink and the hardness and gloss of the film in order to make the recording medium highly adapted to image formation using ink-jet.

For the purpose of the present invention, the term "voids" refers to those having sufficiently large dimensions that are different from those inherently existing in porous silica and those produced when primary particles of silica are agglomerated to form secondary particles. Such voids enable the lower layer to exhibit its inherent ink absorptivity and can even improve the absorptivity. More specifically, the present invention can localize spherical silica particles with the binder interposed therebetween to produce voids with a sufficiently large pore diameter so that the ingredients of the ink that collides with the recording medium are immediately absorbed by the latter by way of the voids.

As described above, the porous upper layer comprises agglomerates of spherical silica particles and the binder and voids. However, for obtaining a porous upper layer containing satisfactory large voids for the purpose of the invention, it is necessary to adequately select spherical silica particles and a binder as well as the type and content of the solvent contained in the dispersive solution to be applied to form the layer and the drying condition to be used in the manufacturing process. No prior art methods disclose these requirements to be filled to manufacture a recording medium according to the invention.

Spherical silica particles to be used for the purpose of the present invention preferably have a particle diameter mainly between 1 and 100 nm. If the particle diameter is less than the above range, some of the pores in the porous upper layer may be diminished, thus reducing the total volume of the pores and also the average pore diameter of the recording medium so that consequently the permeability of ink of the recording medium will be degraded. This may give rise to the phenomenon of ink overflowing during the recording process and hence there may arise various problems including feathering (a problem of producing an area colored by the dye or the pigment of ink that is greater than the printed area when a solid image is printed in the latter area), bleeding (a problem of mixed colors that occurs along the interface of different colors of ink), and beading (a problem of density fluctuations appearing as dot-like stains that occurs due to agglomeration of ink droplets in printed solid images). Moreover, if the porous upper layer contains spherical silica particles having a particle diameter smaller than 1 nm, they will be less easily agglomerated so that agglomerates will be produced only partially and locally in the porous upper layer and consequently the latter will be apt to produce cracks. If, on the other hand, the particle diameter exceeds the above range, the transparency of the porous upper layer will be degraded so that the recorded image will be blurred by white haze, thus reducing the resolution and the sharpness of the image. The effects of the present invention will become apparent when 85% or more of the spherical silica particles of the porous upper layer have a diameter between 1 and 100 nm.

It is vital for the purpose of the present invention that the silica particles have a spherical profile. As described above, the porous upper layer comprises agglomerates of silica particles and the binder and voids. More specifically, the agglomerates are formed as silica particles and the binder are bound together in the layer. Silica particles show a large specific surface area to provide a high probability of contact with the binder when they are spherical of shape. If such is the case, then they will be bound even stronger and faster with the binder. The use of spherical silica particles is still advantageous in view of the fact that they are required to have a highly symmetric profile when producing voids that are not found only locally but evenly distributed within the layer. Most preferably, the silica particles in the porous upper layer have an almost truly spherical profile. In specific terms, preferably, the silica particles are truly spherical by 60 to 100%.

It is possible to form a porous upper layer comprising agglomerates of spherical silica particles and the binder and voids by confining the diameters of the spherical silica particles of the layer mainly to the above range of 1 to 100 nm. More preferably, spherical silica particles to be used for the purpose of the present invention has a particle diameter mainly between 5 and 90 nm. Additionally, a uniform film quality can advantageously be obtained for the layer by using spherical silica particles having a diameter that is confined within a limited range rather than using particles having a diameter that can vary over a wide range. Particularly, when forming a porous upper layer containing silica particles showing a single peak particle diameter distribution, it is possible to produce voids that provide both a satisfactory level of transparency and that of absorptivity by limiting the diameters of silica particles mainly to a range between 20 and 80 nm. The layer can advantageously provide an improved absorptivity and an appropriate film strength if the porous upper layer contains silica particles having a diameter between 30 and 70 $\mu$m.

Figure 4:
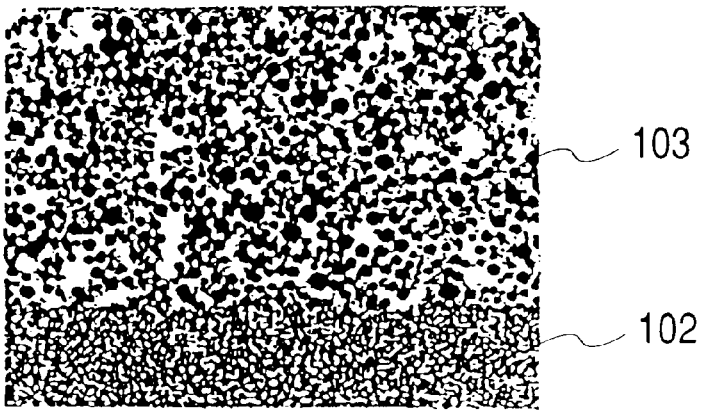
FIG. 4 is a schematic copied illustration of a picture obtained by observing a cross section of a recording medium according to the invention through a transmission type electron microscope.

Additionally, a strong film quality can advantageously be obtained for the porous upper layer by making it contain spherical silica particles of two different diametrical types including large spherical silica particles and small spherical silica particles. This is because, when forming agglomerates of spherical silica particles and the binder, spherical silica particles having a small particle diameter are taken into binder clots, while spherical silica particles having a large particle diameter are arranged outside the clots to improve the physical strength of the binder clots. This positional arrangement of spherical silica particles can be realized effectively when large spherical silica particles and small spherical silica particles show a sufficiently large diametrical difference. More specifically, it is preferable that the porous upper layer contains spherical silica particles having a diameter between 10 and 100 nm and those having a diameter between 1 and 10 nm. It is advantageous that large spherical silica particles having a diameter between 10 and 100 nm are similar to those showing a single peak particle diameter distribution as described above. When the porous upper layer contains spherical silica particles of two different diametrical types including large spherical silica particles and small spherical silica particles, their diametrical ratio is preferably between 70:30 and 95:5. The porous upper layer may contain spherical silica particles of three different diametrical types so as to regulate the size, the number and the distribution pattern of voids. Note that the structure of the porous upper layer of a recording medium according to the invention and the diameters of the spherical silica particles contained in the layer can be observed by way of an electron microscope or a laser microscope after cutting it by means of a microtome to expose a cross section as shown in FIG. 4.

Various materials can be used for the base material layer 101 of a recording medium according to the invention. Specific examples of materials that can be used for the purpose of the invention include paper of various types including paper processed for appropriate sizing, paper not processed for sizing and resin-coated paper typically carrying a polyethylene film layer and thermoplastic film. Thermoplastic film materials that can be used for the purpose of the invention include polyester such as polyethyleneterephthalate, polycarbonate, polystyrene, polyvinylchloride, polymethylmethacrylate, cellulose acetate and polystyrene. Preferably, the base material layer 101 is white and highly opaque in order to form an image like that of photography. A sheet of any such material that is opaqued by filling it with hydrated alumina or a pigment such as titanium white or by the finely foaming effect may preferably be used for the base material layer. A highly transparent sheet of any such material is used for the base material layer of a recording medium that should transmit light when used for an OHP (over head projector), X-ray photography or electronic phototypesetting. Such a transparent sheet shows a light transmissivity of 50% or more, preferably 80% or more. Note that the base material layer may contain one or more pigments of various types to make the base material layer semi-opaque and/or colored for the purpose of regulating the color tone of the entire image formed on the recording medium.

The base material layer may be subjected to a surface treatment process such as corona process for improving its adhesiveness relative to the porous lower layer or provided with an adhesive underlayer. Furthermore, the base material layer may additionally be provided with an anti-curl layer on the rear surface thereof or in appropriate areas thereof. Such an anti-curl layer may be a resin layer or a pigment layer.

While there is no specific limit for the thickness of the base material layer, it preferably has a thickness between 5 and 500 $\mu$m, although the thickness may be selected appropriately depending on the application of the recording medium comprising the base material layer.

The porous lower layer 102 of a recording medium according to the invention comprises hydrated alumina showing a boehmite structure and a binder agent. The porous lower layer basically operates to absorb the solvent of the ink droplets ejected from an ink-jet recording system and colliding with the recording medium and fix the colorants of the ink droplets that may be dyes. For the purpose of the invention, the porous lower layer is required to operate as an ink receiving layer and show a high absorptivity and a uniform film quality in order to minimize feathering and overflowing and form an image like that of photography. Additionally, the special micro-structure of the porous lower layer comprising alumina showing a boehmite structure and a binder agent can be fully exploited when forming the porous upper layer 103. This is because of the fact that such a porous lower layer is highly transparent and that, as a porous upper layer containing voids as described above is formed on the porous lower layer having such a dense micro-structure, alcohol and water can permeate into the layers instantaneously so that they can be discharged in a well balanced manner in the subsequent drying process to optimize the void structure of the porous upper layer. Additionally, the recording medium will show an enhanced ink absorptivity once such a porous upper layer is formed.

In order for the porous lower layer to show a satisfactory absorptivity, the pore size of the layer has to be elaborately regulated. The average pore radius is preferably within a range between 2.0 and 20.0 nm. Then, both the rate of ink absorption and the rate of fixing the dyes can be raised advantageously.

The effect of scattering light of the porous lower layer can be suppressed in order to enhance the transparency of the layer and the appearance of a hazy printed image can be avoided when the average pore radius is less than 10 nm. The distribution pattern of pore size can be determined by means of nitrogen adsorption/desorption porosimetry or mercury intrusion porosimetry.

Additionally, the total volume of all the pores relative to the weight of the porous lower layer is preferably between 0.1 and 1.0 cc/g, more preferably between 0.4 and 0.6 cc/g. If the total volume per unit weight of the pores of the porous lower layer exceeds the above range, the layer may exhibit cracks and falling powder during the process of forming it. If, on the other hand, the volume per unit weight of the pores of the porous lower layer is less than the above range, the layer may exhibit poor ink absorptivity. Still additionally, the porous lower layer has a pore volume per unit area of not less than 8 $cc/m^2$ because the layer shows a poor ink absorptivity and a phenomenon of ink overflowing when an image is printed in multi-color and hence there may arise various problems including feathering. Japanese Patent Application Laid-Open No. 7-2430 describes a recording medium comprising an ink-receiving layer of pseudo-boehmite containing pores having a radius between 10 and 100 nm and occupying a volume per unit weight of 0.1 cc/g or less. Japanese Patent No. 2,714,352 describes a recording medium comprising an ink-receiving layer containing pores having an average radius between 2.0 and 20.0 nm and a half width of pore radius distribution between 2.0 and 15.0 nm. Japanese Patent No. 2,714,350 describes a recording medium comprising an ink-receiving layer containing pores with a pore radius distribution peak value found at 10.0 nm and another distribution peak value found between 10.0 and 20.0 nm. Japanese Patent Application Laid-Open No. 5-323037 describes a recording medium comprising two pseudo-boehmite layers including a lower layer having a thickness between 5 and 60 $\mu$m and containing pores with an average half diameter between 2 and 8 nm and an upper layer having a thickness between 2 and 30 $\mu$m and containing pores with an average radius between 4 and 15 nm. Finally, Japanese Patent Application Laid-Open No. 9-66664 describes a recording medium comprising an ink-receiving layer containing voids in the inside that communicate with the surface of the ink-receiving layer by way of pores having a diameter smaller than the voids. As a matter of fact, any of the above described porous layers can be used for the porous lower layer 102 of a recording medium according to the invention to broaden the choice of ink that can be used for the recording medium. The transparency, the ink absorptivity, particularly for multi-color printing, and the effect of preventing feathering and blurring can be improved by using such a porous lower layer. Finally, the above advantages are enhanced and additional advantages are brought in by forming a porous upper layer 103 thereon.

The hydrated alumina of the porous lower layer is cationic and bears a positive electric charge so that the dyes in ink can be fixed well to produce highly glossy and well colored images. Additionally, it makes the layer transparent with little haze if compared with an ink-receiving layer containing some other pigment. Hence it is highly advantageous when used as pigment for forming an ink-receiving layer.

Hydrated alumina to be used for the purpose of the invention preferably shows a boehmite structure (and a peak diffraction angle 2θ of 14 to 15°) when observed by X-ray diffractometry in order to realize a good adsorptivity for dyes and a good absorptivity and a good transparency for ink. Hydrated alumina is expressed by the general formula shown below:

$$Al_2O_{3-n}(OH)_{2n}\cdot mH_2O,$$

where n represents an integer of 0, 1, 2 or 3 and m represents a numerical value between 0 and 10, preferably between 0 and 5, although both m and n should not be equal to 0 at the same time. The term $mH_2O$ is used to represent the aqueous phase of hydrated alumina that does not participate in the formation of crystal lattice and hence can be eliminated so that m may take a numerical value other than an integer. The value of m can get to 0 when the hydrated alumina is calcined.

Crystalline hydrated alumina showing a boehmite structure that can suitably be used for the purpose of the invention is a laminated compound whose (020) plane is a huge plane and that shows a diffraction peak that is specific to it on a X-ray diffraction pattern. The boehmite structure may be a perfect structure or a pseudo-boehmite structure containing excessive water in the interlayer of the (020) plane. The X-ray diffraction pattern of a pseudo-boehmite structure shows a diffraction peak broader than that of the X-ray diffraction pattern of a perfect boehmite structure. However, since it is not possible to clearly discriminate perfect boehmite and pseudo-boehmite from each other, the expression "hydrated alumina showing a boehmite structure" will be used indiscriminately in the document regardless if the structure is a perfect boehmite structure or a pseudo-boehmite structure. Additionally, hydrated alumina showing a boehmite structure may or may not contain silica for the purpose of the invention (because the silica contained in hydrated alumina may be trapped in the interlayer of the latter).

Any appropriate process may be used for preparing hydrated alumina showing a boehmite structure for the purpose of the invention. Processes that can be used for preparing hydrated alumina showing a boehmite structure for the purpose of the invention include the Bayer process and the process of thermally decomposing alum. In a preferable process, long-chained aluminum alkoxide is hydrolyzed by adding acid. Long chained alkoxide refers to one having 5 or more carbon atoms for the purpose of the invention. Preferably, alkoxide having 12 to 20 carbon atoms is used because such a compound provides the advantage that the alcohol content can be removed with ease and the hydrated alumina having a boehmite structure can be controlled without difficulty in terms of molecular shape. The above described process is advantageous over the process of preparing alumina hydrogel or cationic alumina because it allows less impurities such as various ions to enter the reaction system. Long-chained aluminum alkoxide provide an additional advantage that alcohol can be removed with ease after hydrolysis to make the produced hydrated alumina completely free from alcohol if compared with the use of sort-chained alkoxide such as aluminum isoproxide.

The molecular shape of hydrated alumina having a boehmite structure can be determined by dispersing the hydrated alumina to be observed into alcohol, dropping the dispersive solution on collodion film to prepare a specimen and subsequently observing it through a transmission type electron microscope. It is known from a document (Roček J., et al, Applied Catalysis; vol. 74, pp. 29–36, 1991) that pseudo-boehmite can show a ciliary shape or some other shape in hydrated alumina.

For the purpose of the invention, hydrated alumina having a ciliary shape or a flat plate-like shape may be used indiscriminately. The shape of hydrated alumina (including the shape, the diameter and the aspect ratio of particles) can be determined by dispersing the hydrated alumina to be observed into ion-exchange water, dropping the dispersive solution on collodion film to prepare a specimen and subsequently observing it through a transmission type electron microscope. Note that hydrated alumina having a flat plate-like shape can advantageously be used over needle-shaped hydrated alumina or hair bundle-like agglomerates (having a ciliary shape) of hydrated alumina because it can be dispersed into water very well and the ink-receiving layer prepared by using such hydrated alumina shows random orientation of hydrated alumina particles to produce a large pore volume and a wide distribution of pore diameters. The expression of hair bundle-like agglomerates refers to needle-shaped pieces of hydrated alumina that are gathered side by side like bundles of hair.

For the purpose of the invention, hydrated alumina is conditioned for the properties of pores it contains during the manufacturing process. The pore volume per unit weight of hydrated alumina is preferably between 0.1 and 1.0 ml/g in order to meet the requirements of BET specific surface area and pore volume of the ink-receiving layer. It is difficult to observe the above defined range of pore volume of the porous lower layer if the pore volume per unit weight of hydrated alumina is found outside the above range. As for the particle size of hydrated alumina, preferably the aspect ratio is between 3 and 10 and the average particle diameter is between 1 and 50 nm when the hydrated alumina comprises flat plate-like pieces. The aspect ratio of a flat plate-like piece of hydrated alumina is the ratio of the diameter to the thickness of the piece and can be determined by using the method defined in Japanese Patent Application Laid-Open No. 5-16015. If the particle size is found lower than the above range, the porous lower layer is apt to produce cracks. If, on the other hand, the particle sized is found higher than the above range, the porous lower layer is apt to scatter light to produce haze and make the printed image appear rather pale.

For the purpose of the invention, hydrated alumina preferably shows a BET specific surface area between 40 and 500 $m^2/g$. If the BET specific surface area is found outside the above range, it will be highly-difficult to confine the specific surface area of the ink-receiving layer to the above defined range. The BET specific surface area and the pore volume can be determined by means of the nitrogen adsorption/desorption process after deaerating the specimen at 120° C. for 24 hours.

According to the invention, hydrated alumina can be used with an additive. Additives that can be used for the purpose of the invention include, various metal oxides, various metal hydroxides, salts of divalent and polyvalent metals, halogenated metals and cationic organic substances.

Metal oxides or hydroxides that can be used as additives for the purpose of the invention include silica, silica alumina, boria, silica boria, magnesia, silica magnesia, titania, zirconia and zinc oxide. Salts of divalent and polyvalent metals that can be used as additives for the purpose of the invention include salts such as calcium nitrate, calcium carbonate and barium sulfate, halogenated metals such as magnesium chloride, calcium bromide, calcium iodide, zinc chloride, zinc bromide and zinc iodide, kaoline and talc. Cationic organic substances that can be used as additives for the purpose of the invention include quarternary ammonium salts, polyamines and aklylamines. The selected one or more than one additives are added to the pigments by less than 20 weight %.

The binder agent to be used in combination with the pigment is preferably selected from polymeric substances that are water-soluble or can disperse in water or various solvents including alcohol. Preferable examples of such substances include polyvinylalcohol (PVA) and denatured substances thereof (cation-denatured substances, anion-denatured substances, silanol-denatured substances), starch and denatured substances thereof (oxides and ethers thereof), gelatine and denatured substances thereof, casein and denatured substances thereof, cellulose derivatives such as carboxymethylcellulose, gum arabic, hydroxyethylcellulose and hydroxypropylmethylcellulose, conjugated diene type copolymer latexes such as SBR latex, NBR latex and methylmethacrylate-butadiene copolymer, functional-group-denatured polymeric latexes, vinyl type copolymer latexes such as ethylene-vinylacetate copolymer, polyvinylpyrrolidone, maleic anhydride and copolymer thereof and acrylic ester copolymer. Of the above listed substances PVA is popularly used in view of water absorption and transparency. Resin emulsion as disclosed in Japanese Patent Application Laid-Open No. 8-325992 or Japanese Patent Application Laid-Open No. 10-94754 may also be used for the purpose of the invention. Any one of the above listed binder agents may be used solely or in combination with some other binder as mixture.

So long as the above requirement of the BET specific surface area and that of the pore volume are met for the porous lower layer, the selected pigment and the selected binder may be combined with a mixing ratio between 1:1 and 30:1 by weight, preferably between 5:1 and 20:1. If the amount of the binder is less than the above range, the ink-receiving layer may show an insufficient mechanical strength giving rise to cracks and falling powder. If, on the other hand, the amount of the binder exceeds the above range, the pore volume is reduced, degrading the ink absorptivity of the layer.

Thus, a solution to be applied is prepared by using hydrated alumina and the selected binder agent and then applied onto the base material layer to produce a porous lower layer 102.

A dispersant, a thickener, a pH adjuster, a lubricant, a fluidity modifier, a surfactant, an anti-foaming agent, a water proofing agent, a foam inhibitor, a peeling agent and/or an anti-soot agent may be added to the solution to be applied.

Techniques that can be used for the operation of applying the solution onto the base material layer include blade coating, air-knife coating, roll coating, flush coating, gravure coating, kiss-roll coating, dye coating, extrusion coating, slide hopper coating, curtain coating and spray coating as well as other appropriate coating techniques.

The rate of applying the solution may be selected appropriately depending on the application of the finished product. However, the recording medium would not absorb ink satisfactorily and might give rise to a feathering problem if the applied layer is too thin. On the other hand, the porous lower layer of the recording medium would have insufficient strength and become defective when the applied solution is dried making it partially incapable of satisfactorily absorbing ink if the applied layer is too thick. Additionally, the transparency of the recording medium would be damaged, degrading the clarity and the sharpness of the printed image if the applied layer is too thick. Thus, the porous lower layer preferably has a thickness between 5 and 50 $\mu$m in order to secure a desired level of absorptivity and overall film strength.

If necessary, the layer formed on the base material layer by applying the above solution may be heated and dried to produce the porous lower layer. The aqueous medium (dispersant) is evaporated as a result of the drying process and a film is formed as a result of the binding effect produced by bridging or fusing the hydrated alumina particles and the binder. The conditions under which the drying process is conducted will be determined as a function of the composition of the solution to be applied. The drying process may be carried out by means of a hot air drying furnace and/or an infrared drying furnace. While the formed layer may be dried perfectly by completely dissipating the solvent in the drying process, it may alternatively be half-dried in this drying process because, any way, it will be perfectly dried in the subsequent process of drying the porous upper layer.

The porous upper layer 103 of a recording medium according to the invention is vital in determining the absorptivity and the transmissivity of the recording medium relative to the solvent of the ink ejected onto the medium, the fixation of the colorants of the ink and the surface properties of the recording medium. Generally speaking, the ink absorptivity of the recording medium is advantageously high if the porous inorganic pigment layer containing an inorganic pigment and a binder agent has a two-layered configuration. However, a recording medium used with a recording apparatus that uses specially designed inks at an enhanced rate to meet the rigorous requirements for the image quality comparable to that of photographs is often required to show a particularly high ink absorption rate. In a recording medium according to the invention, the porous upper layer is made to comprise spherical silica particles and a binder and contain voids that are arranged optimally to make it effectively absorb ink at a high rate.

Figure 5A:
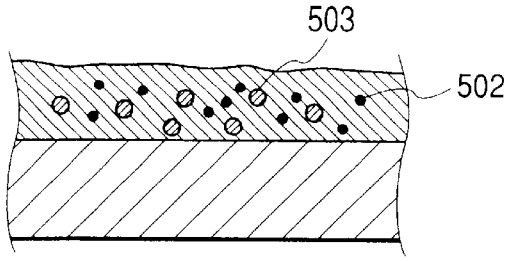
FIGS. 5A, 5B, 5C, 5D, 5E, 5F and 5G are schematic cross sectional views of a recording medium according to the invention showing the porous upper layer in different manufacturing steps including application, drying, and forming.
Figure 5B:
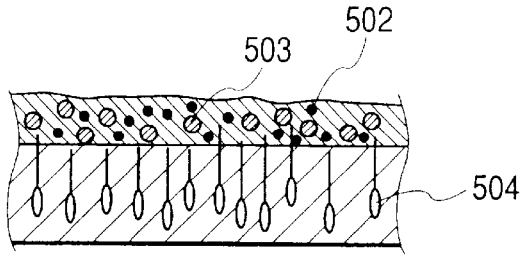
Figure 5C:
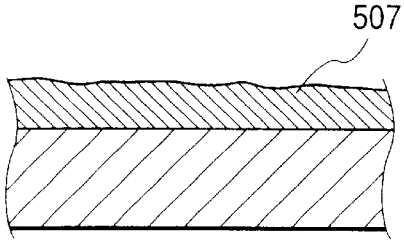
Figure 5D:
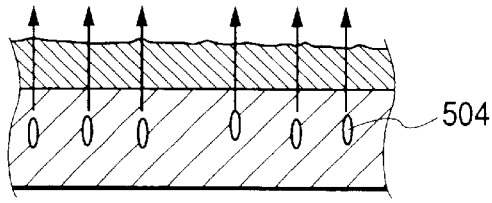
Figure 5E:
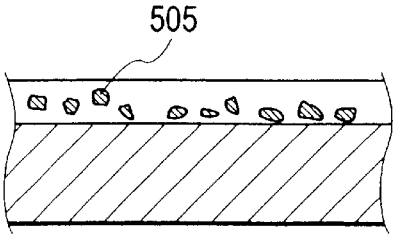
Figure 5F:
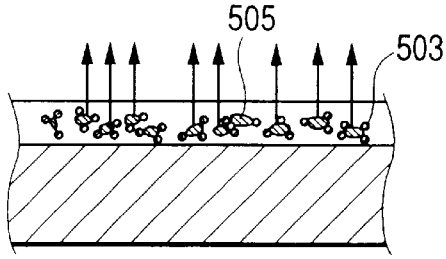
Figure 5G:
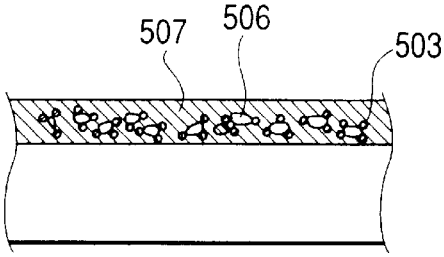

FIGS. 5A through 5G are schematic cross sectional views of a recording medium according to the invention showing the porous upper layer in different manufacturing steps including application, drying, and forming. To be more accurate, FIG. 5A shows the step of applying the solution to be applied and FIG. 5B shows how the solvent permeates into the porous lower layer, while FIG. 5C shows that the applied solution is agglomerating weakly and FIG. 5D shows how the alcohol component evaporates. Further, FIG. 5E shows how the resin emulsion on the surface and then in the inside start to be fused and FIG. 5F shows how moisture evaporates. Finally, FIG. 5G shows the stage of completion of the fusion of the resin emulsion in the inside of the film formed by applying the solution.

As will be understood by seeing the above drawings, certain conditions have to be satisfied to form the film layer. The conditions and the effects of satisfying them will be discussed hereinafter. Firstly, as pointed out earlier, the spherical silica particles in the film are required to have a diameter mainly found between 1 and 100 nm. This requirement has to be met in order to make the spherical silica particles of the film not agglomerate when forming the porous upper layer so that the size of the voids there may be regulated so as not to adversely affect the absorptivity and the transparency of the layer. Additionally, unlike water-soluble resin such as PVA or alcohol-soluble resin that are used with conventional methods, where the resin is completely dissolved into the solvent such as water and/or alcohol, particles of emulsion type thermoplastic resin are used and dispersed into water and alcohol with the manufacturing method according to the invention. Therefore, resin particles operate as binder agent as they are gradually fused and bound together and hence voids survive without being crushed throughout the application step and the drying step.

Additionally, while the solvent of the dispersive solution to be applied to form a porous upper layer contains both water and alcohol, alcohol is removed first as it evaporates and subsequently water moves out in the drying step because of the difference of volatility of the two substances. This means that the applied solution is dried in a surface zone first to produce a relatively dense film there. Then, the moisture remaining in the inside is dried gradually to produce voids that replace the droplets of water lingering in the inside in final stages of the drying step. Additionally, since moisture can be attracted to spherical silica particles that are more hydrophilic than the binder agent and hence relatively large number of water droplets are removed from around the spherical silica particles in the solution, voids are mainly formed between agglomerates of silica and the binder agent and not found in the inside of the agglomerates. Still additionally, the alcohol contained in the applied solution can prevent defects from being produced in the film of the solution in a manner as described hereinafter. If the solution applied onto the porous lower layer contains only water as dispersant, air bubbles in the pores of the porous lower layer can rise up to produce defects in the film formed by applying the solution because water moves into the pores only slowly. If the solution contains alcohol too as dispersant as in the case of the present invention, the solvent quickly moves into the pores of the porous lower layer to suppress the phenomenon of rising air bubbles and hence prevents defects from being produced in the film. Thus, the possibility of producing defects that are referred to as repelling in printed solid images in areas where the colorants are not fixed can be minimized in the image forming process.

In order to form a porous upper layer where both agglomerates of silica and the binder agent and voids coexist, colloidal silica particles that are uniformly dispersed into a dispersant solution to form colloid will advantageously be used for the purpose of the invention. Normally, colloidal silica is a dispersive solution obtained by stably dispersing ultramicro-particles of silicic anhydride (silica) into water or alcohol. For the purpose of the present invention, however, colloidal silica is required to be dispersed into a solvent of a mixture of water and alcohol.

Both the use of anionic colloidal silica and that of cationic colloidal silica may be conceivable for the purpose of the invention. When anionic colloidal silica is used for the purpose of the invention, the colorants and other ingredients of ink can pass through or become absorbed by the voids formed in the porous upper layer with ease because the ink droplets colliding with the recording medium are normally anionic. Then, both some of the colorants and the solvent of the ink can get to the porous lower layer and become fixed there. When cationic colloidal silica is used for the purpose of the invention, on the other hand, the porous upper layer also participates in fixing the colorants of ink so that they are fixed even if the ink arriving on the recording medium is absorbed slowly and hence overflows. All in all, anionic colloidal silica may preferably be used for the purpose of the invention to produce a highly transparent porous upper layer because acidic colloidal silica can be dispersed well in alcohol.

As for the diameter of colloidal silica particles, they preferably have an average particle diameter between 1 and 100 nm and show a peak value of particle diameter distribution between 1 and 100 nm. If the colloidal silica contains particles not found within the particle diameter range of 1 to 100 nm, such particles may have to be separated by a known technique. For the purpose of the invention, it is preferable that more than 85% of the spherical silica particles are found within the particle diameter range of 1 to 100 nm. If the silica particles fall below the diameter range, they will mostly adhere and become bound to each other to produce agglomerates of silica particle or be taken into binder clots so that consequently only a plane film will be produced with few voids and pores and hence the purpose of the present invention of producing voids will not be realized. If, on the other hand, the silica particles exceed the diameter range, the voids produced in the film will be too big, making the adhesion of the silica particles and the binder insufficient. Then, the produced film will not be strong enough nor sufficiently transparent. Preferably, for the purpose of the invention, the colloidal silica particles of the porous upper layer have a diameter between 5 and 90 nm. More particularly, when forming a porous upper layer by using spherical colloidal silica particles showing a single peak particle diameter distribution, it is possible to produce voids that provide both a satisfactory level of transparency and absorptivity by limiting the diameters of silica particles to a range between 20 and 80 nm. The layer can advantageously provide an improved absorptivity and an appropriate film strength if the porous upper layer contains spherical colloidal silica particles having a diameter between 30 and 70 $\mu$m.

Additionally, a strong film quality can advantageously be obtained for the porous upper layer by making it contain spherical colloidal silica particles of two different diametrical types including large spherical silica particles and small spherical silica particles. This arrangement of using two different diametrical ranges is particularly advantageous when the porous upper layer contains spherical silica particles having a diametrical distribution peak between 10 and 100 nm and those having a diametrical distribution peak between 1 and 10. It is also advantageous that large spherical colloidal silica particles with the range between 10 and 100 nm are similar to those showing a single peak particle diameter as described above. When the porous upper layer contains spherical colloidal silica particles of two different diametrical types including large spherical colloidal silica particles and small spherical colloidal silica particles, their diametrical ratio is preferably between 70:30 and 95:5 and their mixing ratio is preferably between 55:45 and 95:5 by weight.

Generally known techniques including the quasi-elastic laser scattering (dynamic light scattering) technique may be used to determine the diameters of the colloidal silica particles contained in the ink-receiving layers and see if the diameters are within a limited range and show a peak value.

For the purpose of the present invention, resin emulsion to be used for forming a porous upper layer is dispersed in water or in a mixture of water and alcohol and not dissolved into water and/or alcohol to form a solution to be applied to the surface of a corresponding porous lower layer.

Specific examples of emulsion that can be used for the purpose of the invention include synthetic resin emulsion such as vinyl acetate emulsion, ethylene-vinyl acetate emulsion, ethylene-vinyl acetate copolymer type emulsion, vinyl acetate-acryl copolymer type emulsion, acryl-styrene emulsion, acryl emulsion, vinylidene chloride type emulsion, urethane emulsion and polyester emulsion and synthetic rubber latex such as SBR latex and MBR latex.

The resin emulsion to be used for the purpose of the invention preferably shows a glass transition temperature between 10 and 150° C. If the resin emulsion has a glass transition temperature lower than the above range, the produced porous upper layer may become tacky and sticky and many of the voids formed in the inside may be crushed because the melt viscosity of the resin emulsion is consequently too low during the drying process. Additionally, the applied film may become white and hazy to reduce the transparency of the layer. If, on the other hand, the resin emulsion has a glass transition temperature higher than the above range, it will not be fused sufficiently in the drying process and would not operate satisfactorily as binder to make it hardly possible to produce a strong film. If the resin particles are not fused in the film layer to a large extent, the layer would become more hazy and less transparent. More preferably, the glass transition temperature of the resin emulsion is between 30 and 140° C.

For the purpose of the invention, it is indispensable that the resin emulsion is fused to operate as binder in the drying process. Therefore, the selected resin emulsion should not be gelled rapidly when used in combination with spherical colloidal silica and dispersed in the solution to be applied to the underlying layer.

The particles of the resin emulsion to be used for the purpose of the invention should have a diameter between 0.03 and 0.5 $\mu$m. If the diameter is less than the above range, the resin particles behave almost like those dissolved in solvent so that they would not be gradually fused in the drying process to produce voids in a manner as described above. If the diameter exceeds the above range, the agglomerates of spherical silica particles and the binder agent that are formed as resin particles will be fused in the drying process and will take a large space and thus, the voids formed as a result of the fusion will show a diameter that can vary over a wide range so as to lose uniformity in terms of ink absorption. The particles of the resin emulsion to be used for the purpose of the invention preferably have a diameter between 0.03 and 0.5 $\mu$m.

The compounding ratio of spherical colloidal silica and resin emulsion may be selected from a range between 30:1 and 1:1, in terms of the ratio of their solid contents, and depending on the particle diameter, the ionic properties, the type of the spherical colloidal silica, and the type of resin emulsion. By confining the compounding ratio to that above range, appropriate agglomerates of silica particles and the binder and voids are produced in the layer. If the resin emulsion used is less than the above range, the porous upper layer will be deficient in mechanical strength. If the resin emulsion exceeds the above range, the porous upper layer will be deficient in voids and show a reduced ink permeability. From the point of view of compatibility of the ink permeability and improved mechanical strength of the porous upper layer, the compounding ratio is preferably found within a range between 20:1 and 3:1.

Both water and alcohol are used in the dispersant for dispersing spherical colloidal silica and resin emulsion for the purpose of the invention, and the alcohol content of the dispersant is advantageously between 30 and 90%. As a solution containing spherical colloidal silica and resin emulsion dispersed in a dispersant containing alcohol within the above range is applied onto the porous lower layer and dried, voids are formed within the layer because alcohol is dried and removed more quickly than water. If the alcohol content is too low and the water content is too high, voids will be formed to an unnecessarily large extent and the film layer formed by applying the solution will show white haze. Additionally, the time required for the drying process will be prolonged. If, on the other hand, the alcohol content is too high and the water content is too low, voids will not be formed to a satisfactory extent and the formed layer would not show a sufficient level of absorptivity. When the alcohol content is found outside the above range, the agglomerates of silica particles and the binder agent and the voids will lose the balance, making it no longer possible to produce a void structure necessary for the purpose of the invention. Preferably, the alcohol content of the dispersant is between 50 and 80%. For the purpose of the invention, alcohol is required to be more volatile than water and dissolved into water in the dispersant. Additionally, the dispersant containing such alcohol should disperse resin emulsion without dissolving it and also disperse spherical colloidal silica without precipitating it. Specific examples of alcohol that can suitably be used for the purpose of the invention include relatively lower alcohols such as methanol, ethanol, isopropanol and butanol as well as other kinds of alcohol if such alcohol can permeate quickly into the porous lower layer and is more volatile than water, while satisfying the above requirements. Not only a single type of alcohol but also two or more different types of alcohol may be selectively used for the purpose of the invention.

For the purpose of the invention, the colloidal silica, the resin emulsion and the dispersant of the porous upper layer may be accompanied by any of the following additives; coupling agent, pigment dispersant, thickening agent, pH adjuster, lubricant, flow modifier, anti-foaming agent, foam-inhibitor, water-proofing agent, releasing agent, foaming agent, penetrant, colorant, fluorescent brightener, UV absorber, anti-oxidant, antiseptic, etc.

Of the above listed additives, the use of a coupling agent is effective for improving the mechanical strength of the porous upper layer because it encourages the adhesion of spherical particles of silica that is an inorganic substance and the binder agent that is an organic substance. When using a coupling agent for the purpose of the invention, it may effectively be added in advance to colloidal silica or to the dispersant solution of colloidal silica and resin emulsion. Coupling agents that can be used for the purpose of the invention include those of the cyan type, the titanate type, the aluminum type or the zirconium type, although the use of a silane coupling agent is advantageous because it reacts well with colloidal silica and makes it strongly coupled with the binder.

Any known techniques for dispersing colloidal silica and resin emulsion into a dispersant may be used for the purpose of the invention. Specific examples of such techniques include the use of an agitator type dispersing machine such as a homo-mixer or a homo-disperser and that of a grinder type dispersing machine such as a ball mill or a sand mill.

Techniques for applying the solution containing colloidal silica and resin emulsion for forming the porous upper layer 103 on the porous lower layer 102 include blade coating, air-knife coating, roll coating, flush coating, gravure coating, kiss-roll coating, dye coating, extrusion coating, slide hopper coating, curtain coating and spray coating as well as other appropriate coating techniques.

The rate of applying the solution for forming a porous upper layer 103 on the porous lower layer 102 may be selected appropriately depending on the application of the finished product. However, the porous upper layer would not satisfactorily provide the effect of operating as a firm surface layer to improve the damage-resistance and the ink-absorbing property of the recording medium if it is too thin, whereas it would damage the transparency of the recording medium and the sharpness of the recorded image if it is too thick because defects can be produced in the layer during the application and drying process or the layer can become hazy and poorly transparent. Specifically, the solution is applied at a rate between 0.05 and 20 $g/m^2$, preferably between 0.5 and 20 $g/m^2$. When dried, the porous upper layer preferably has a thickness between 0.1 and 10 $\mu$m.

When forming the porous upper layer 103 by applying the solution, the solid content and the viscosity of the solution have to be regulated by adjusting the rate of adding alcohol and selecting the type of colloidal silica and that of resin emulsion. The solid content is preferably between 3 and 30% by weight when producing an appropriate and uniform film thickness. While the viscosity may be regulated appropriately depending on the application performance of the applicator machine, it is preferably between 1 and 100 cps for producing a thin and uniform film.

Thus, the porous upper layer 103 is formed by subsequently drying the solution, if necessary, by heating it. As the solvent evaporates during the drying process, a weak agglomeration occurs in the formed film to produce agglomerates of spherical silica particles and resin emulsion as the solvent is gradually lost from the layer. Additionally, voids are produced as the moisture that used to fill the gaps of the agglomerates is partly lost also through evaporation. Finally, the resin emulsion in the agglomerates are fused by heat and silica becomes firmly bound with the binder agent. Thus, the film forming process is completed to produce the porous upper layer when the film layer is cooled.

The drying process has to be conducted at a temperature higher than the glass transition temperature of the resin emulsion in order to thermally fuse the resin emulsion and produce a film out of the applied solution. Preferably the drying process is conducted at or above 100° C. in order to curtail the drying time by encouraging the moisture in the solvent to evaporate. Needless to say, the time and the temperature of the drying process should be such that they would neither deform nor discolor the base material layer underlying the porous lower and upper layers.

The prepared porous upper layer 103 shows a pore structure produced by specifically designed voids in a manner as described below. Preferably, the radius distribution of the pores of the porous upper layer shows a maximum peak value that is found between 10 and 200 nm. Various properties desired for the porous upper layer including absorptivity, transparency and damage-resistance can coexist when the above requirement is met. Particularly, the transparency and the damage-resistance of the porous upper layer can be improved although the absorptivity may not be remarkably improved when the radius distribution of the pores of the porous upper layer shows a maximum peak value found between 10 and 20 nm. On the other hand, the absorptivity of the porous upper layer becomes remarkable with an enhanced absorbing rate so that the layer can operate as a buffer layer for temporarily holding the applied ink in the printing process where ink is applied densely in a single scanning operation in a manner as will be described hereinafter when the radius distribution of the pores of the porous upper layer shows a maximum peak value found between 20 and 200 nm. These pores are formed in the layer as thin as 0.1 to 10 $\mu$m to ensure the above properties.

In a recording medium according to the invention, the radius distribution of the pores of the porous lower and upper layers 102 and 103 shows a maximum peak value that is found between 2.0 and 20 nm. In other words, the lower layer may take most of the pores of the two layers showing a maximum peak value of the radius distribution of pores as defined above, while the upper layer may well contain the smallest number of pores required for improving the absorptivity and the damage-resistance within the range necessary for securing the required level of transparency. With this arrangement, the two layers can take different functional roles including those of absorbing, retaining and transmitting ink and improving the transparency of the recording medium. Particularly, the recording medium can show a high ink absorbing capacity when the volume of the pores of the porous lower layer 102 and those the porous upper layer 103 is found between 0.4 and 1.5 ml/g. Furthermore, the recording medium can be used for a printing operation using ink at a high rate for printing while securing a high level of transparency when the ratio of the volume of pores PV2 of both the porous lower layer 102 and the porous upper layer 103 to the volume of pores PV1 of the porous lower layer 102 is between 1.0 and 1.5.

Since a recording medium according to the invention shows an enhanced level of absorptivity, it can effectively suppress the phenomena of feathering, bleeding and beading that degrade the quality of the image produced on it. Additionally, since it allows the droplets of ink arriving on it to feather to a certain extent, it can reduce defects such as stripy areas appearing with a width of the recording head in printed solid images.

Ink that can be used for forming images on a recording medium according to the invention contains mainly a coloring material (dye or pigment), a water-soluble organic solvent and water. If a dye is contained in the ink, it is preferably a water-soluble dye, which may be a direct dye, an acidic dye, a basic dye, a reactive dye or a food dye that can provide the image formed on the recording medium with necessary properties including fixing property, coloring property, clarity, stability and light fastness. If, on the other hand, a pigment is contained in the ink, it is preferably selected from in inorganic pigments such as carbon black, organic pigments, metal micro-particles, metal oxides and other metal compounds. The selected pigment may be of the self-dispersing type or of the type to be used with a dispersant such as surfactant.

Water-soluble dyes are normally used after being dissolved into solvent that may be water or a mixture of water and a water-soluble organic solvent. The water content of the ink to be used with a recording medium according to the invention is preferably so regulated as to be found within a range between 20 and 90% by weight.

Water-soluble organic solvents that can be used for the purpose of the invention includes alkylalcohols having 1 to 4 carbon atoms such as methyl alcohol, amides such as dimethylformamide, ketones such as acetone or ketone alcohols, ethers such as tetrahydrofuran, polyalkyleneglycols such as polyethyleneglycol, alkyleneglycols with an alkylene group having 2 to 6 carbon atoms such as ethyleneglycol, polyhydric alcohols such as glycerol and lower alkylethers of polyhydric alcohols such as ethyleneglycolmethylether.

Of the above listed water-soluble organic solvents, polyhydric alcohols such as diethyleneglycol and lower alkylethers of polyhydric alcohols such as triethyleneglycolmonomethylether and triethyleneglycolmonoethylether are preferable. The use of polyhydric alcohol is particularly preferable because such a solvent can operate as lubricant for preventing clogged nozzles from occurring when the water content of ink evaporates to deposit one or more than one water-soluble dyes.

A solubilizer may be added to ink. Typical solubilizers are heterocyclic ketones containing nitrogen atoms. The solubility of a water-soluble dye can be dramatically improved relative to solvent when such a solubilizer is used. Preferable examples of solubilizers that can be used for the purpose of the invention include N-methyl-2-pyrrolidone and 1,3-dimethyl-2-imidazolidinone. Furthermore, a viscosity modifier, a surfactant, a surface tension modifier, a pH adjuster and/or a resistivity modifier may be added to improve the characteristics of the ink to be used with a recording medium according to the invention.

Ink is applied onto a recording medium according to the invention by means of an ink-jet recording system. Any ink-jet recording system may be used for the purpose of the invention so long as it is adapted to release ink from a nozzle and apply it onto the recording medium. For example, an ink-jet recording system in which ink is subjected to a rapid volume change by applying thermal energy to it and ejected from a nozzle under the effect of the change of state as disclosed in Japanese Patent Application Laid-Open No. 54-59936 may advantageously be used. Various types of ink including the following may be used with a recording medium according to the invention:

(1) ink containing one or more dyes as colorants;
(2) ink containing one or more pigments as colorants; and
(3) ink containing a mixture of one or more dyes and one or more pigments as colorants or a mixture of ink containing one or more dyes as colorants and ink containing one or more pigments as colorants.

When forming an image on a recording medium according to the invention by using an ink containing one or more dyes as colorants, the phenomenon of bleeding (feathering at boundaries) of the image produced as a combination of solidly printed areas of multi-color ink can be reduced remarkably. Additionally, the printed areas are largely relieved of white haze and the difference in gloss relative to the non-printed areas so that an image like that of a photograph can be obtained. On the other hand, when forming an image on a recording medium according to the invention by using an ink containing one or more pigments as colorants, the printed areas show a high rub fastness and also a high water fastness because the recording medium has a pore structure adapted to capture the pigments. Finally, when forming an image on a recording medium according to the invention by using an ink containing a mixture of one or more dyes and one or more pigments, the droplets of ink striking the recording medium are distributed evenly to eliminate any difference of gloss between the areas covered by the dyes and those covered by the pigments because of the specific pore structure of the recording medium unlike any conventional recording medium where such a difference is observable.

Printing techniques that can be used with a recording medium according to the invention include:

(1) a technique of printing an image by using ink containing different colorants such as dyes and pigments for a single pixel;
(2) a technique of printing an image by using ink containing three or more than three colorants that are different from each other in terms of concentration; and
(3) a high speed printing technique of reducing the number of multi-paths to densely apply a large volume of ink with a single scan in addition to known conventional techniques.

As for the technique of printing an image by using ink containing different colorants such as one or more dyes and one or more pigments for a single pixel that is employed on a recording medium according to the invention, when black ink containing a pigment and some other ink containing a dye are used to raise the printing density of black areas and produce a sharp image, practically no bleeding appears along the boundaries of different inks and the problem of making only the areas printed by black ink glossy does not occur so that an image like that of a photograph can be produced with little difference of gloss among the different colorants. As for the technique of printing an image by using ink containing three or more colorants that are different from each other in terms of concentration, when expressing a smooth gradation from a highlighted area to a shadowed area by overlapping inks with different dye densities, no overflowing occurs from a high density area because of the high ink absorptivity of the recording medium and little difference of gloss appears between printed areas and un-printed areas so that an exquisite image can be formed on the recording medium. Finally, as for the high speed printing technique of reducing the number of multi-paths to densely apply a large volume of ink with a single scan, the image produced by such a technique can maintain a certain satisfying level of quality when such a technique is used because practically no overflowing nor feathering of ink occurs if a large volume of ink arrives on the recording medium at a time, due to the reduced number of paths. More specifically, the large volume of ink arriving on the recording medium having a two-layered structure for the porous ink-receiving layer through a path will initially and mostly be absorbed by the porous lower layer and the overflowing ink that takes only a small part of the overall volume of the ink is temporarily retained by the porous upper layer operating as a buffer layer so that consequently all the ink will be absorbed by the porous lower layer before the next arrival of ink through that path.

EXAMPLES

Now, the present invention will be described by way of examples, although these examples by no means limit the scope of the present invention.

Example 1

A recording medium having a configuration as shown in FIG. 1 was prepared in a manner as described below. A 100 μm thick transparent PET film (100Q80D: tradename, available from Toray) was used for the base material layer 101 and a solution to be applied onto it for forming a porous lower layer 102 was prepared in the following manner.

Firstly, aluminum dodexide was prepared, using the technique disclosed in U.S. Pat. No. 4,242,271, and the prepared aluminum dodexide was hydrolyzed, using the technique disclosed in U.S. Pat. No. 4,202,870, to produce alumina slurry, to which water was added until the solid hydrated alumina occupied 7.9% of the total amount. The pH of the obtained alumina slurry was 9.4. Thereafter, the pH was adjusted by adding a 3.9% aqueous solution of nitric acid and colloidal sol was obtained therefrom through a maturing process. The colloidal sol was then dried by means of a spray-dryer showing an inlet temperature of 83° C. to obtain powdery hydrated alumina having a boehmite structure. The obtained hydrated alumina showing a boehmite crystal structure contained flat plate-like particles with an aspect ratio of 5, an average particle diameter of 21 nm, a BET specific surface area of 200 $m^2/g$ and a specific pore volume of 0.65 ml/g. The shape of particles of the hydrated alumina was determined by dispersing it into ion-exchange water, dropping the dispersive solution on collodion film to prepare specimens and subsequently observing them through a transmission type electron microscope (H-500: tradename, available from Hitachi). The X-ray diffraction pattern was observed by means of a RAD-2R (tradename, available from Rigaku Denki) to confirm that the hydrated alumina had a boehmite structure. The BET specific surface area and the specific pore volume were observed by means of a nitrogen adsorption/desorption process using an instrument called Autosorb 1 (tradename, available from Quanthachrome) after sufficiently heating and deaerating the hydrated alumina.

The hydrated alumina was then dispersed into ion-exchange water to obtain a 15% solution. Then, polyvinylalcohol (Gohsenol GH17: tradename, available from Nippon Synthetic Chemical Industry) was dissoloved into ion-exchange water to obtain a 10% solution. Then, the hydrated alumina and the polyvinylalcohol solution was mixed to a mixing ratio of 7:1 by weight when reduced to solid and the mixture was stirred to obtain the solution to be applied.

The solution was applied to the base material layer in a dye-coating process using a coating machine and dried in a drying process using a hot air heater (hot air temperature: 140° C.) to produce a 40 μm thick porous lower layer 102.

The BET specific surface area of the porous lower layer 102 was 197 $m^2/g$, whereas the maximum peak of the pore radii was 7.5 nm, while the specific volume of the pores was 0.64 ml/g when observed by means of nitrogen adsorption/desorption process using an Autosorb 1 (tradename, available from Quanthachrome) after sufficiently heating and deaerating the sheet carrying the porous lower layer.

Then, another solution for forming a porous upper layer 103 was prepared in a manner as described below. Note that the spherical colloidal silica used for the solution showed a single value of 52 nm for the particle diameter distribution.

Firstly, an aqueous solution containing alkali silicate by 3.60 weight % was processed for $SiO_2$ by means of hydrogen from ion-exchange resin to obtain an aqueous colloidal solution of active silicic acid from which alkali metal ions had been removed. Then, nitric acid was added to the aqueous colloidal solution of active silicic acid to reduce the pH value of the solution to pH 1.54. The solution was then matured and treated sequentially with hydrogen from strongly acidic cation exchange resin, subsequently with hydroxide from strongly basic anion exchange resin and then again with hydrogen from strongly acidic cation exchange resin to obtain an aqueous colloidal solution containing highly pure active silicic acid by 3.52 weight % for $SiO_2$. The particle diameter distribution was observed by means of a dynamic light scattering technique using Coultet N4F (tradename, available from Coulter). Ion-exchanged water was added to the aqueous colloidal solution to obtain a 20% dispersive solution. Then, 10 portions of acrylic resin emulsion (average particle diameter of 0.06 μm, Tg 48° C.) were added to 100 portions of the dispersive solution and then 200 portions of methanol were added as solvent to make the solution contain 8.0% solids. The solution was then stirred to disperse the contents in order to produce the solution to be applied for forming the porous upper layer.

The obtained solution was then applied by dye-coating, using a coating machine (not shown), and dried at 140° C. by means of a hot air heater to obtain a 3 μm thick porous upper layer 103 and produce a complete recording medium 100. A cross section of the obtained recording medium 100 was observed through a transmission type electron microscope (H-500: tradename, available from Hitachi) with a magnifying power of 100,000 to find a structure containing spherical silica particles and the binder agent along with voids as shown in FIG. 2.

The pore radius distribution of the porous upper layer of the recording medium was examined to find a maximum peak at 12.0 nm. The combined pore radius distribution of the porous lower layer 102 and the porous upper layer 103 was also examined to find a maximum peak at 7.5 nm. The specific pore volume of the two layers was found to be equal to 0.698 ml/g. A mercury intrusion technique and an Autopore III (tradename, available from MICROMETICS) were used for the observations conducted after drying specimens of the recording medium at 25° C. in vacuum for 24 hours.

The recording medium 100 was evaluated for the following properties. Table 1 summarily shows the obtained results.

(Evaluation)

(1) Transparency

The transmissivity (%) of total rays of light of the recording medium was observed according to JIS K-7105 and by means of a haze meter (NDH-100DO: tradename, available from Nippon Denshoku Industries).

(2) Surface Conditions

The surface condition of the recording medium was visually checked for cracks. A specimen that was visually free from cracks was rated as good (○), whereas a specimen that was visually found with cracks was rated as poor (x).

(3) Film Strength

The pencil hardness of the recording medium was determined according to JIS K5400. A specimen with the hardness of 3H or above was rated as excellent (◎) and a specimen with the hardness of H or above was rated as good (○), whereas a specimen with the hardness of B or less was rated as fair (Δ) and a specimen with the hardness of 2B or less was rated as poor(x).

(4) Tack, Anti-fingerprint Effect

The surface of the recording medium was checked with bare thumbs (held in contact with the surface of the recording medium for 10 seconds) for tackiness and appearance of fingerprints. A specimen where no fingerprint was found was rated as good (○) and a specimen where one or two fingerprints were found was rated as fair(Δ), whereas a specimen that was tacky to the thumbs was rated as poor(x).

(5) Blocking Effect

Ten specimens of recording medium according to the invention were laid one on the other on a desk and topped by a glass plate of the same size weighing 1 kg. They were then stored under the conditions of 30° C. and 80% RH for 1 month. After the storage period, specimens that were separated from each other without any sticking tendency were rated as good(○) and specimens that were not separable were rated as poor(x).

(6) Printing Characteristics

A drop-on-demand type ink-jet head having 24 nozzles per 1 mm (600 dpi) was used for ink of each of the colors listed below and ink was ejected by means of an ink-jet printer adapted to form an image by scanning in a direction perpendicular to the array of the nozzles at a rate of 10 pl per dot of ink for each of the colors. The volume of ink used for mono-color printing with 24×24 dots per 1 $mm^2$ (600 dpi×600 dpi) was referred to as 100%. Thus, the volume of ink used for printing in two-color printing using two different mono-color inks was referred to as 200% and the volume of ink used for three-color printing using thee different inks was referred to as 300%, while the volume of ink used for four-color printing using four different inks was referred as 400% and so on. The dyes for different inks were listed below.

Y: C. I. Direct Yellow 86

M: C. I. Acid Red 35

C: C. I. Direct Blue 199

Bk: C. I. Food Black 2

The following different color inks were prepared respectively by using the above listed dyes.

| | | |
|---|---|---|
| 1) | ink composition 1: | high dye density ink |
| | dye: | 3 portions |
| | diethyleneglycol | 5 portions |
| | polyethyleneglycol | 10 portions |
| | water | 82 portions |
| 2) | ink composition 2: | medium dye density ink |
| | dye: | 1 portions |
| | diethyleneglycol | 5 portions |
| | polyethyleneglycol | 10 portions |
| | water | 84 portions |
| 3) | ink composition 3: | low dye density ink |
| | dye: | 0.6 portions |
| | diethyleneglycol | 5 portions |
| | polyethyleneglycol | 10 portions |
| | water | 84.4 portions |

The above set of inks were used and the obtained prints were evaluated for the following printing characteristics.

(1) Presence of Feathering, Bleeding, Beading, Repelling and Defective Stripy Printing Solid images were printed by using the above described printing apparatus and different volumes of ink of the ink composition 1 ranging 100% (mono-color) to 400% (four-color) for each color and visually observed for the presence of feathering, bleeding, beading, repelling and defective stripy printing.

The printings not giving rise to such defects with the ink volume of 400%, 300%, 100% were rated respectively as exellent(◎), good(○) and fair(Δ), whereas the printing producing such defects with the ink volume of 100% was rated as poor(x).

(2) Image Density

Solid images were printed by using the above described printing apparatus and a 100% volume (mono-color) of ink of the ink composition 1 for each color and observed for the transmitted image density of the image by means of 310TR (tradename, available from X-Rite).

(3) Changes of Tint Attributable to the Number of Gradation Stages and Density

The above set of inks with the different ink compositions of 1) to 3) were used to print images on the recording medium by means of the above printing apparatus, while varying the rate of ejecting each ink to produce about 60 stages for gradation. Then, the printed images were visually observed and the printing was rated as good gradation when the different stages of gradation were recognizable and then the recognizable stages were counted.

Also the tint was visually observed for changes. Each of the printed images was rated as good(○) when no change of tint was visually recognizable, as fair(Δ) when less than 3 changes of tint were recognizable and poor(x) when 3 or more than 3 changes of tint were recognizable.

Example 2

Specimens of recording medium 100 were prepared by forming a porous upper layer 103 in a manner as described above by referring to Example 1 except that the peak value of the particle diameter distribution of spherical colloidal silica of this example was shifted to 0.08, 1.0, 10, 30, 50, 70, 100 and 150 nm. Then, the recording medium was observed through a transmission type electron microscope as in Example 1 to find a void structure specific to the present invention. The recording medium 100 was evaluated for the properties (1) through (6) as in Example 1. Table 2 summarily shows the obtained results.

Example 3

Specimens of recording medium 100 were prepared by forming a porous upper layer 103 in a manner as described above for Example 1 except that two different types of colloidal silica, one with a peak value of the particle diameter distribution of spherical colloidal silica equal to 50 nm and the other with a peak value of the particle diameter distribution of spherical colloidal silica equal to 8 nm, the ratio by weight of the amount of larger colloidal silica particles to that of smaller colloidal silica particles being equal to 10:1. Then, the recording medium was observed through a transmission type electron microscope as in Example 1 to find a void structure specific to the present invention. The recording medium 100 was evaluated for the properties (1) through (6) as in Example 1. Table 1 also summarily shows the obtained results of this example.

Example 4

Specimens of recording medium 100 were prepared by forming a porous upper layer 103 in a manner as described above for Example 1 except that two different types of colloidal silica, one with a peak value of the particle diameter distribution of spherical colloidal silica equal to 90 nm and the other with a peak value of the particle diameter distribution of spherical colloidal silica equal to 40 nm, the ratio by weight of the amount of larger colloidal silica particles to that of smaller colloidal silica particles being equal to 10:1. Then, the recording medium was observed through a transmission type electron microscope as in Example 1 to find a void structure specific to the present invention. The recording medium 100 was evaluated for the properties (1) through (6) as in Example 1. Table 1 also summarily shows the obtained results of this example.

Example 5

Specimens of recording medium 100 were prepared by forming a porous upper layer 103 in a manner as described above for Example 1 except that three different types of colloidal silica with respective peak values of the particle diameter distribution of spherical colloidal silica equal to 70 nm, 40 nm and 20 nm, the ratio by weight of the amounts of large, medium and small colloidal silica particles being equal to 10:3:1. Then, the recording medium was observed through a transmission type electron microscope as in Example 1 to find a void structure specific to the present invention. The recording medium 100 was evaluated for the properties (1) through (6) as in Example 1. Table 1 also summarily shows the obtained results of this example.

Example 6

Specimens of recording medium 100 were prepared by forming a porous upper layer 103 in a manner as described above by referring to Example 1 except that composite colloidal silica having organic groups introduced on the surface was used. The peak value of the particle diameter distribution of composite colloidal silica of this example was equal to 59 nm. Then, the recording medium was observed through a transmission type electron microscope as in Example 1 invention. The recording medium 100 was evaluated for the properties (1) through (6) as in Example 1. Table 3 summarily shows the obtained results.

Example 7

Specimens of recording medium 100 were prepared by forming a porous upper layer 103 in a manner as described above by referring to Example 1 except that aluminum composite colloidal silica was used. The peak value of the particle diameter distribution of aluminum composite colloidal silica of this example was equal to 51 nm. Then, the recording medium was observed through a transmission type electron microscope as in Example 1 to find a void structure specific to the present invention. The recording medium 100 was evaluated for the properties (1) through (6) as in Example 1. Table 3 also summarily shows the obtained results.

Example 8

Specimens of recording medium 100 were prepared by forming a porous upper layer 103 in a manner as described above by referring to Example 1 except that polyester resin emulsion was used. The average particle diameter of polyester resin emulsion was equal to 0.08 $\mu$m and Tg was equal to 58° C. in this example. Then, the recording medium was observed through a transmission type electron microscope as in Example 1 to find a void structure specific to the present invention. The recording medium 100 was evaluated for the properties (1) through (6) as in Example 1. Table 3 also summarily shows the obtained results.

Example 9

Specimens of recording medium 100 were prepared by forming a porous upper layer 103 in a manner as described above by referring to Example 1 except that styrene-acryl copolymer resin emulsion was used. The average particle diameter of styrene-acryl copolymer resin emulsion was equal to 0.06 $\mu$m and Tg was equal to 98° C. in this example. Then, the recording medium was observed through a transmission type electron microscope as in Example 1 to find a void structure specific to the present invention. The recording medium 100 was evaluated for the properties (1) through (6) as in Example 1. Table 3 also summarily shows the obtained results.

Example 10

Specimens of recording medium 100 were prepared by forming a porous upper layer 103 in a manner as described above by referring to Example 1 except that vinyl acetate-acryl copolymer resin emulsion was used. The average particle diameter of vinyl acetate-acryl copolymer resin emulsion was equal to 0.06 $\mu$m and Tg was equal to 38° C. in this example. Then, the recording medium was observed through a transmission type electron microscope as in Example 1 to find a void structure specific to the present invention. The recording medium 100 was evaluated for the properties (1) through (6) as in Example 1. Table 3 also summarily shows the obtained results.

Example 11

Specimens of recording medium 100 were prepared by forming a porous upper layer 103 in a manner as described above by referring to Example 1 except that two types of resin emulsion including acrylic resin emulsion and vinyl acetate-acryl copolymer resin emulsion. The mixing ratio of acrylic resin emulsion to vinyl acetate-acryl copolymer resin emulsion was 7:1 when reduced to solid. Then, the recording medium was observed through a transmission type electron microscope as in Example 1 to find a void structure specific to the present invention. The recording medium 100 was evaluated for the properties (1) through (6) as in Example 1. Table 3 also summarily shows the obtained results.

Example 12

Specimens of recording medium 100 were prepared by forming a porous upper layer 103 in a manner as described above by referring to Example 1 except that the glass transition temperature of acrylic resin emulsion was shifted to 0, 10, 30, 50, 70, 100, 140, 150 and 200° C. Then, the recording medium was observed through a transmission type electron microscope as in Example 1 to find a void structure specific to the present invention. The recording medium 100 was evaluated for the properties (1) through (6) as in Example 1. Table 4 summarily shows the obtained results.

Example 13

Specimens of recording medium 100 were prepared by forming a porous upper layer 103 in a manner as described above by referring to Example 1 except that the P/B ratio of spherical colloidal silica particles to acrylic resin emulsion of this example was shifted to 0.5:1, 1:1, 3:1, 7:1, 20:1, 30:1 and 40:1. Then, the recording medium was observed through a transmission type electron microscope as in Example 1 to find a void structure specific to the present invention. The recording medium 100 was evaluated for the properties (1) through (6) as in Example 1. Table 5 summarily shows the obtained results.

Example 14

Specimens of recording medium 100 were prepared by forming a porous upper layer 103 in a manner as described above by referring to Example 1 except that methanol content of the solvent contained in the solution to be applied of this example was shifted to 10, 30, 50, 70, 90 and 98%. Then, the recording medium was observed through a transmission type electron microscope as in Example 1 to find a void structure specific to the present invention. The recording medium 100 was evaluated for the properties (1) through (6) as in Example 1. Table 6 summarily shows the obtained results.

Example 15

Specimens of recording medium 100 were prepared by forming a porous upper layer 103 in a manner as described above by referring to Example 1 except that a silane coupling agent was added to the solution to be applied. More specifically, the silane coupling agent was γ-methacryloxypropyltrimethoxysilane and added by a ratio of 100:1 relative to spherical colloidal silica when reduced to solid. Then, the recording medium was observed through a transmission type electron microscope as in Example 1 to find a void structure specific to the present invention. The recording medium 100 was evaluated for the properties (1) through (6) as in Example 1. Table 3 also summarily shows the obtained results.

Example 16

Specimens of recording medium 100 were prepared by forming a porous upper layer 103 in a manner as described above by referring to Example 1 except that a silane coupling agent was added to the solution to be applied as in Example 14. The ratio by weight of the amount of larger colloidal silica particles to that of smaller colloidal silica particles being equal to 10:1. Then, the recording medium was observed through a transmission type electron microscope as in Example 1 to find a void structure specific to the present invention. The recording medium 100 was evaluated for the properties (1) through (6) as in Example 1. Table 3 also summarily shows the obtained results.

Example 17

Specimens of recording medium 100 were prepared by forming a porous upper layer 103 in a manner as described above by referring to Example 1 except that the porous lower layer 102 was an alumina layer containing voids in the inside and the surface of the porous lower layer was made to communicate with the porous upper layer by way of pores having a half diameter smaller than the voids.

The porous lower layer 102 was formed in a manner as described below. Ethyleneglycol was added to colloidal sol of hydrated alumina similar to the one used in Example 1 at a rate of 5/100 relative to the total volume of colloidal sol and the mixture was stirred as in Example 1. Then, the mixture was dried at 145° C. by means of a sprayer-drier to obtain xerogel. Ion-exchange water was added to the xerogel and the mixture was stirred as in Example 1 to obtain a dispersive solution of hydrated alumina with a solid concentration of 15 weight %. The dispersive solution was applied to a base material layer and dried as in Example 1 to form a 40 μm thick porous lower layer 102. The BET specific surface area of the porous lower layer 102 was 227 $m^2/g$, whereas the maximum peak of the pore radiuss was 7.7 nm, while the specific volume of the pores was 0.670 ml/g when observed by means of nitrogen adsorption/desorption process using an Autosorb 1 (tradename, available from Quanthachrome) after sufficiently heating and deaerating the sheet carrying the porous lower layer. A cross section of the produced porous lower layer 102 was observed through a transmission type electron microscope (H-500: tradename, available from Hitachi) to find voids with a diameter between 50 and 150 nm. Then, a porous upper layer 103 was formed as in Example 1 to produce a recording medium 100. The pore radius distribution of the porous upper layer 102 of the recording medium 100 was examined as in Example 1 to find a maximum peak at 13.5 nm. The combined pore radius distribution of the porous lower layer 102 and the porous upper layer 103 was also examined to find a maximum peak at 7.7 nm. The specific pore volume of the two layers was found to be equal to 0.704 ml/g. The recording medium was observed through a transmission type electron microscope as in Example 1 to find a void structure specific to the present invention. The recording medium 100 was evaluated for the properties (1) through (6) as in Example 1. Table 7 summarily shows the obtained results.

Example 18

Specimens of recording medium 100 were prepared by forming a porous upper layer 103 in a manner as described above by referring to Example 1 except that the porous lower layer 102 was an alumina layer having a pseudo-boehmite structure where the volume of the pores with the smaller half diameter was reduced relative to that of Example 1.

Firstly, a solution to be applied was prepared by using 5 weight portions of pseudo-boehmite sol Kataloid AS-3 (tradename, available from Shokubai Kasei), 1 weight portion of polyvinylalcohol PVA 117 (tradename, available from Kuraray) and water to make it contain solid by 10 weight %. Then, the solution was applied onto the base material layer 101. The BET specific surface area of the porous lower layer 102 was 185 $m^2/g$. As for the relationship between the pore radius and the pore volume, the pore volume per unit weight was relatively small and equal to 0.02 ml/g within the pore half diameter range of 10 to 100 nm, whereas it was relatively large and equal to 0.23 ml/g within the pore half diameter range of 4 to 10 nm and equal to 0.50 ml/g within the pore half diameter range of 1 to 4 nm to prove that the porous upper layer 102 contained small pores to a large extent. After forming the porous upper layer 103, the pore radius distribution of the porous upper layer 103 of the recording medium 100 was examined as in Example 1 to find a maximum peak at 10.6 nm. The combined pore radius distribution of the porous lower layer 102 and the porous upper layer 103 was also examined to find a maximum peak at 7.4 nm. The specific pore volume of the two layers was found to be equal to 0.643 ml/g. The recording medium was observed through a transmission type electron microscope as in Example 1 to find a void structure specific to the present invention. The recording medium 100 was evaluated for the properties (1) through (6) as in Example 1. Table 7 also summarily shows the obtained results.

Example 19

Specimens of recording medium 100 were prepared by forming a porous upper layer 103 in a manner as described above by referring to Example 1 except that the porous lower layer 102 was an alumina layer formed by using emulsion for the binder agent.

Firstly, the precipitate obtained by hydrolyzing aluminium isopropoxide was loosened to obtain alumina sol containing hydrated alumina particles having an average secondary agglomerate diameter of 170 nm by 19 weight %. Then, 95 portions of aqueous dispersive solution of cationic acryl type resin particles (average particle size of 0.01 $\mu$m) containing solid by 30 weight % was added to 500 weight portions of the alumina sol and the mixture was stirred to obtain a solution to be applied onto a base material layer. The solution was applied and dried as in Example 1 to form a porous lower layer 102 with a thickness of 40 $\mu$m. The BET specific surface area of the porous lower layer 102 was 193 $m^2$/g, whereas the maximum peak of the pore radiuss was 7.5 nm, while the specific volume of the pores was 0.682 ml/g. After forming the porous upper layer 103, the pore radius distribution of the porous upper layer 103 of the recording medium 100 was examined as in Example 1 to find a maximum peak at 11.8 nm. The combined pore radius distribution of the porous lower layer 102 and the porous upper layer 103 was also examined to find a maximum peak at 7.6 nm. The specific pore volume of the two layers was found to be equal to 0.673 ml/g. The recording medium was observed through a transmission type electron microscope as in Example 1 to find a void structure specific to the present invention. The recording medium 100 was evaluated for the properties (1) through (6) as in Example 1. Table 7 also summarily shows the obtained results.

Example 20

Specimens of recording medium 100 were prepared by forming a porous upper layer 103 in a manner as described above by referring to Example 1 except that alumina containing silica was used for the porous lower layer 102.

Firstly, alkoxide was prepared, using the technique disclosed in U.S. Pat. No. 4,242,271 and 100 weight portions of the prepared alkoxide was mixed with ion-exchange water and 8.45 weight portions of ortho-silicic acid. The mixture solution was put into a reaction vessel and stirred for 30 minutes to hydrolyze the alkoxide at 110° C. Ion-exchange water was used by the same weight as that of alkoxide. The suspension was then dried by means of a spray-dryer showing an inlet temperature of 280° C. to obtain powdery hydrated alumina containing silica. When examined by X-ray diffractometry, the obtained hydrated alumina was found to have a boehmite structure.

The obtained hydrated alumina was then dispersed into ion-exchange water as in Example 1 to obtain a 15 weight % solution. Then, polyvinylalcohol (Gohsenol NH-18: tradename, available from Nippon Synthetic Chemical Industry) was dissoloved into ion-exchange water to obtain a solution containing solid by 10% weight. Then, the hydrated alumina and the polyvinylalcohol solution was mixed to a mixing ratio of 10:1 by weight when reduced to solid and the mixture was stirred to obtain the solution to be applied.

The solution was applied to a base material layer and dried as in Example 1 to form a 40 $\mu$m thick porous lower layer 102. The BET specific surface area of the porous lower layer 102 was 195 $m^2$/g, whereas the maximum peak of the pore radii was 7.4 nm, while the specific volume of the pores was 0.687 ml/g. After forming the porous upper layer 103, the pore radius distribution of the porous upper layer 103 of the recording medium 100 was examined as in Example 1 to find a maximum peak at 11.0 nm. The combined pore radius distribution of the porous lower layer 102 and the porous upper layer 103 was also examined to find a maximum peak at 7.4 nm. The specific pore volume of the two layers was found to be equal to 0.679 ml/g. The recording medium was observed through a transmission type electron microscope as in Example 1 to find a void structure specific to the present invention. The recording medium 100 was evaluated for the properties (1) through (6) as in Example 1. Table 7 also summarily shows the obtained results.

Example 21

Specimens of recording medium 100 were prepared by forming a porous upper layer 103 in a manner as described above by referring to Example 1 except that the layer had a two-layered structure of pseudo-boehmite with different pore radii.

Firstly, 720 g of ion-exchange water and 676 g of isopropanol were put into a glass reaction vessel having a capacity of 2,000 cc. Then, the mixture solution was heated at 75° C. and aluminum propoxide was added thereto by 306 g, while stirring the solution, to allow it to be hydrolyzed, at 75 to 78° C. for 5 hours. Thereafter, the temperature was raised to 95° C. and acetic acid was added by 9 g to loosen the precipitate at 75 to 78° C. for 48 hours. Then, the solution was condensed until it weighed 900 g to obtain-hydrated alumina sol. After drying the sol, it was confirmed by X-ray diffractometry that it had a pseudo-boehmite structure. Then, 1 weight portion of polyvinylalcohol (Gohsenol NH-18: tradename, available from Nippon Synthetic Chemical Industry) was added to the hydrated alumina sol and ion-exchange water was also added thereto to obtain a solution containing solid by 10 weight %. Then, the solution was applied to a base material layer 101 and dried as in Example 1 to form a lower layer for the lower layer of the porous lower layer 102.

Subsequently, 540 g of ion-exchange water and 676 g of isopropanol were put into a glass reaction vessel having a capacity of 2,000 cc. Then, the mixture solution was heated at 75° C. and aluminum propoxide was added thereto by 306 g, while stirring the solution, to allow it to be hydrolyzed, at 75 to 78° C. for 5 hours. Thereafter, the temperature was raised to 95° C. and acetic acid was added by 9 g to loosen the precipitate at 75 to 78° C. for 48 hours. Then, the solution was condensed until it weighed 900 g to obtain hydrated alumina sol. After drying the sol, it was confirmed by X-ray diffractometry that it had a pseudo-boehmite structure. Then, 1 weight portion of polyvinylalcohol (Gohsenol NH-18: tradename, available from Nippon Synthetic Chemical Industry) was added to the hydrated alumina sol and ion-exchange water was also added thereto to obtain a solution containing solid by 10 weight %. Then, the solution was applied to the lower layer of the two layers of hydrated alumina to complete the process of forming the porous lower layer 102. The lower layer of the porous lower layer 102 was a 20 $\mu$m thick pseudo-boehmite layer with a pore radius of 5 nm, whereas the upper layer was a 10 $\mu$m thick pseudo-boehmite layer with a pore radius of 6 nm. The recording medium was observed in a manner as described for Example 1.

After forming the porous upper layer 103, the pore radius distribution of the porous upper layer 103 of the recording medium 100 was examined as in Example 1 to find a maximum peak at 11.6 nm. The combined pore radius distribution of the porous lower layer 102 and the porous upper layer 103 was also examined to find a maximum peak at 5 nm. The specific pore volume of the two layers was found to be equal to 0.653 ml/g. The recording medium was observed through a transmission type electron microscope as in Example 1 to find a void structure specific to the present invention. The recording medium 100 was evaluated for the properties (1) through (6) as in Example 1. Table 7 also summarily shows the obtained results.

Example 22

In this example, an ink set of pigment inks were used as colorants for recording images on a recording medium as in Example 1.

The pigments for different inks were listed below.

Y: C. I. Pigment Yellow 83

M: C. I. Pigment Red 48:3

C: C. I. Pigment Blue 15:3

Bk: C. I. Carbon Black

A dispersive pigment solution was obtained for ink of each of the colors by dispersing the corresponding pigment, using a known dispersing technique and the following dispersant.

| | |
|---|---|
| pigment | 15 weight portions |
| copolymer of polyethyleneglycolmonoacrylate to which oxyethylene groups were introduced by 45 mols and sodium acrylate [mol ratio of monomers (former acrylate/latter acrylate) = 2/8] | 3 weight portions |
| monoethanolamine | 1 weight portion |
| diethyleneglycol | 5 weight portion |
| ion-exchange water | 76 weight portions |

The following different color inks were prepared respectively by using the above listed pigment dispersive solutions.

| | | |
|---|---|---|
| <1> | ink composition 4: | high pigment density ink |
| | pigment dispersive solution: | 33 portions |
| | diethyleneglycol | 4 portions |
| | ion-exchange water | 63 portions |
| <2> | ink composition 5: | medium pigment density ink |
| | pigment dispersive solution: | 11 portions |
| | diethyleneglycol | 4 portions |
| | ion-exchange water | 85 portions |
| <3> | ink composition 6: | low pigment density ink |
| | pigment dispersive solution: | 6.6 portions |
| | diethyleneglycol | 4 portions |
| | ion-exchange water | 89.4 portions |

The above set of inks were used and the obtained prints were evaluated for (6) as described for Example 1. The following evaluations were added.

(7) Fixing Effect of Colorants

Solid images were printed by using the above described printing apparatus and a volume of 100% ink (mono-color) of the ink composition 4 for each color and, after drying, the printed area was rubbed with a finger tip to see the degree to which the colorant came off. The colorant that did not come off was rated as good(○), whereas the colorant that came off was rated as poor(x).

(8) Difference in Glossiness of Printed Sections Depending on Colorant

Solid images were printed by using the above described printing apparatus and a volume of 100% of ink (mono-color) of the ink composition 4 for each color to visually observe the difference in glossiness of the printed area. The result was rated as good(○) when no difference was observed in the printed area depending on the use of pigment or that of dye, whereas it was rated as poor(x) when difference was recognized in the printed area depending on the use of pigment or that of dye.

The recording medium 100 was evaluated for the properties (6) through (8). Table 8 summarily shows the obtained results.

Example 23

Images were formed on the recording medium as in Example 1 by using both pigment ink and dye ink in this example.

An ink set comprising the dye inks of Y, M and C and the pigment ink of Bk was used with the above described recording apparatus to produce images. The recording medium 100 was evaluated for the properties (6) through (8) as in Example 22. Note that the ink set of high density inks were used for evaluating the properties (7) and (8). Table 8 also summarily shows the obtained results.

Example 24

In this example, a set of inks as listed below were prepared by mixing a pigment and a dye for each color and was used for recording images on a recording medium as in Example 1.

| | | |
|---|---|---|
| [1] | ink composition 7: | high dye/pigment mixture density ink |
| | dye: | 1.5 portions |
| | pigment dispersive solution: | 16.5 portions |
| | diethyleneglycol | 4.5 portions |
| | polyethyleneglycol | 5 portions |
| | water | 72.5 portions |
| [2] | ink composition 8: | medium dye/pigment mixture density ink |
| | dye: | 0.5 portions |
| | pigment dispersive solution: | 5.5 portions |
| | diethyleneglycol | 4.5 portions |
| | polyethyleneglycol | 5 portions |
| | water | 84.5 portions |
| [3] | ink composition 9: | low dye/pigment mixture density ink |
| | dye: | 0.3 portions |
| | pigment dispersive solution: | 3.3 portions |
| | diethyleneglycol | 4.5 portions |
| | polyethyleneglycol | 5 portions |
| | water | 86.9 portions |

Images were formed on the recording medium by using the above described recording apparatus and the recording medium 100 was evaluated for the properties (6) through (8) as in Example 22. Note that the ink set of high density inks of Bk, Y, M and C were used for evaluating the properties (7) and (8). Table 8 also summarily shows the obtained results.

Comparative Example 1

Specimens of recording medium 100 were prepared in a manner as described above by referring to Example 1 except that no porous upper layer was formed. Then, the recording medium 100 was evaluated for the properties (1) through (6) as in Example 1. Table 1 also summarily shows the obtained results.

Comparative Example 2

Specimens of recording medium 100 were prepared in the manner described above, referring to Example 1, except that porous micro-particles of silica were used for the silica of the porous upper layer. The porous micro-particles of silica of the solution had an average particle diameter of 30 μm and the specific volume of pores was 1.5 ml/g. Then, the solution was applied and dried to form a porous upper layer containing porous micro-particles of silica. A cross section of the produced layer was observed through a transmission type electron microscope (H-500: tradename, available from Hitachi) to find that the structure comprising spherical silica particles, binder agent, and voids, as shown in FIG. 2, was not observable there and porous micro-particles of silica were arranged irregularly, the gaps being filled with the binder agent. Then, images were formed on the recording medium and evaluated for the properties (1) through (6) as in Example 1. Table 1 also summarily shows the obtained results.

Comparative Example 3

Specimens of recording medium 100 were prepared in a manner as described above by referring to Example 1 except that the porous upper layer did not contain any resin binder. A cross section of the produced layer was observed through a transmission type electron microscope (H-500: tradename, available from Hitachi) to find that the structure comprising spherical silica particles, the binder agent and voids as shown in FIG. 2 was not observable there and spherical primary silica particles were regularly arranged to form a multilayer structure. Then, images were formed on the recording medium and evaluated for the properties (1) through (6) as in Example 1. Table 1 also summarily shows the obtained results.

Comparative Example 4

After forming a porous lower layer 102 as in Example 1, an upper layer was formed in a manner as described below. A silica sol solution (polyvinylalcohol copolymer/$SiO_2$=0.1 (by weight), no alcohol being contained in the solution) containing solid by 5 weight % and comprising silica sol of spherical primary particles with a sol particle diameter within a range between 35 and 55 nm and polyvinylalcohol copolymer having silanol groups (R-Polymer R-1130: tradename, available from Kuraray) was applied onto a porous layer 102 and heat treated at 140° C. to produce a 1 μm thick upper layer. A cross section of the produced layer was observed through a transmission type electron microscope (H-500: tradename, available from Hitachi) to find that the structure comprising spherical silica particles, the binder agent and voids as shown in FIG. 2 was not observable there and spherical primary silica particles were regularly arranged to form a multilayer structure that replaced the porous upper layer. Then, images were formed on the recording medium and evaluated for the properties (1) through (6) as in Example 1. Table 1 also summarily shows the obtained results.

Comparative Example 5

Specimens of recording medium 100 were prepared in a manner as described above by referring to Example 1 except that non-spherical silica particles were used for the porous upper layer. A cross section of the produced layer was observed through a transmission type electron microscope (H-500: tradename, available from Hitachi) to find that the structure comprising spherical silica particles, the binder agent and voids as shown in FIG. 2 was not observable there and small gaps were found among masses of chained silica, which partially carried cracks. Then, images were formed on the recording medium and evaluated for the properties (1) through (6) as in Example 1. Table 1 also summarily shows the obtained results.

Comparative Example 6

After forming a porous lower layer 102 as in Example 1, an upper layer was formed in a manner as described below. Agglomerates of synthetic amorphous silica (primary particle diameter: 11 nm) having an average diameter of 3 μm were dispersed by means of a sand grinder and subjected to ultrasonic waves. This cycle of dispersing agglomerates by means of a sand grinder and subjecting them to ultrasonic waves was repeated until the average particle diameter of agglomerates was reduced to 300 nm, when they were dispersed into water to produce a 15% aqueous dispersive solution. Then, the solution to be applied that contained solid by 8 weight % was prepared from 100 weight portions of the dispersive solution and 40 weight portions of polyvinylalcohol (RVA-124: tradename, available from Kuraray). The obtained solution was then applied onto a porous layer 102 and heat treated at 140° C. to produce a 3 μm thick upper layer. A cross section of the produced layer was observed through a transmission type electron microscope (H-500: tradename, available from Hitachi) to find that the structure comprising spherical silica particles, the binder agent and voids as shown in FIG. 2 was not observable there and the agglomerates of silica were larges and wrapping the binder. Thus, no structure of FIG. 2 was found and the cross section was partially white. Then, images were formed on the recording medium and evaluated for the properties (1) through (6) as in Example 1. Table 1 also summarily shows the obtained results.

Comparative Example 7

Specimens of recording medium 100 were prepared in a manner as described above by referring to Example 1 except that the hydrated alumina having a boehmite structure of the porous lower layer 102 was replaced by silica (Mizukasil P78-A: tradename, available from Mizusawa Kagaku). The BET specific surface area of the silica was 350 $m^2/g$ and the average particle diameter was 3.0 μm. After forming the porous upper layer 103, images were formed on the recording medium and evaluated for the properties (1) through (6) as in Example 1. Table 1 also summarily shows the obtained results.

As described above in detail, a recording medium according to the invention comprises a base material layer, a porous lower layer made of hydrated alumina having a boehmite structure and a binder agent and a porous upper layer comprising agglomerates formed by spherical silica particles with a diameter between 1 and 100 and a binder agent and voids mainly found among the agglomerates of spherical silica particles and not within the agglomerates. With this arrangement, the prepared recording medium shows excellent properties including a high image density, a sharp color tone, a large number of gradation stages, no change of tint that can occur depending on the density in ordinary recording medium, no appearance of beading, a high ink absorptivity, a strong resistivity against surface damage and an enhanced transparency even when ink is applied by a large amount at a time for high speed printing and/or when different types of ink containing various pigments and dyes are used.

TABLE 1

| Items of evaluation | Example 1 | Comparative Example 1 | Comparative Example 2 | Comparative Example 3 | Comparative Example 4 | Comparative Example 5 | Comparative Example 6 | Comparative Example 7 | Example 3 | Example 4 | Example 5 |
|---|---|---|---|---|---|---|---|---|---|---|---|
| (1) Transparency, transmissivity to total rays of incident light (%) | 80.2 | 8.23 | 70.3 | 74.3 | 81.0 | 70.2 | 74.8 | 68.2 | 81.3 | 80.0 | 80.1 |
| (2) Surface property, presence cracks | ○ | ○ | Δ | Δ | ○ | X | Δ | X | ○ | ○ | ○ |
| (3) Film strength, pencil hardness test | ○ | Δ | Δ | X | Δ | Δ | Δ | ○ | ◎ | ○ | ○ |
| (4) Presence of tack and finger prints | ○ | X | ○ | ○ | ○ | ○ | ○ | ○ | ○ | ○ | ○ |
| (5) Blocking property | ○ | X | ○ | ○ | ○ | ○ | ○ | ○ | ○ | ○ | ○ |
| (6) Printing characteristics | | | | | | | | | | | |
| (1) Presence of image defects | | | | | | | | | | | |
| Feathering | ◎ | ○ | X | X | Δ | X | X | X | ◎ | ◎ | ◎ |
| Bleeding | ◎ | ○ | X | X | X | X | X | X | ◎ | ◎ | ○ |
| Beading | ◎ | Δ | ○ | ○ | Δ | Δ | Δ | Δ | ◎ | ◎ | ◎ |
| Repellency | ○ | Δ | ○ | ○ | ○ | ○ | ○ | ○ | ○ | ○ | ○ |
| Stripy flaws | ◎ | Δ | ○ | ○ | Δ | ○ | Δ | Δ | ○ | ◎ | ○ |
| (2) Image density | | | | | | | | | | | |
| Bk | 2.01 | 2.00 | 1.89 | 1.79 | 1.89 | 1.82 | 1.85 | 1.65 | 2.01 | 2.00 | 2.01 |
| Y | 1.94 | 1.93 | 1.86 | 1.75 | 1.86 | 1.76 | 1.79 | 1.55 | 1.95 | 1.93 | 1.94 |
| M | 1.94 | 1.92 | 1.85 | 1.72 | 1.88 | 1.79 | 1.82 | 1.56 | 1.95 | 1.93 | 1.94 |
| C | 1.95 | 1.94 | 1.88 | 1.75 | 1.92 | 1.82 | 1.85 | 1.58 | 1.96 | 1.94 | 1.93 |
| (3) Number of gradation stages | 40 | 40 | 30 | 30 | 30 | 30 | 30 | 30 | 40 | 40 | 40 |
| (4) Change of tint | ○ | ○ | Δ | X | X | Δ | Δ | Δ | ○ | ○ | ○ |

TABLE 2

| | Example 2 | | | | | | | |
|---|---|---|---|---|---|---|---|---|
| Items of evaluation/ Grain diameter (μ) | 0.08 | 1 | 10 | 30 | 50 | 70 | 100 | 150 |
| (1) Transparency, transmissivity to total rays of incident light (%) | 82.3 | 81.4 | 81.2 | 80.5 | 80.2 | 79.9 | 77.3 | 74.3 |
| (2) Surface property, presence cracks | X | Δ | ○ | ○ | ○ | ○ | ○ | ○ |
| (3) Film strength, pencil hardness test | ○ | ○ | ○ | ○ | ○ | ○ | Δ | X |
| (4) Finger contact test, presence of tack and finger prints | Δ | Δ | ○ | ○ | ○ | ○ | ○ | ○ |
| (5) Blocking property | Δ | ○ | ○ | ○ | ○ | ○ | ○ | ○ |
| (6) Printing characteristics | | | | | | | | |
| (1) Presence of image defects | | | | | | | | |
| Feathering | X | Δ | Δ | ○ | ◎ | ◎ | ◎ | ○ |
| Bleeding | X | Δ | Δ | ○ | ◎ | ◎ | ◎ | ◎ |
| Beading | X | Δ | Δ | ○ | ◎ | ◎ | ◎ | ◎ |
| Repellency | ○ | ○ | ○ | ○ | ○ | ○ | ○ | ○ |
| Stripy flaws | Δ | Δ | Δ | ○ | ◎ | ◎ | ◎ | ○ |
| (2) Image density | | | | | | | | |
| Bk | 1.95 | 1.96 | 1.97 | 2.01 | 2.01 | 2.00 | 1.92 | 1.89 |
| Y | 1.92 | 1.93 | 1.93 | 1.95 | 1.94 | 1.92 | 1.90 | 1.82 |
| M | 1.93 | 1.93 | 1.92 | 1.95 | 1.94 | 1.92 | 1.91 | 1.83 |
| C | 1.91 | 1.91 | 1.92 | 1.94 | 1.95 | 1.91 | 1.90 | 1.86 |
| (3) Number of gradation stages | 30 | 40 | 40 | 40 | 40 | 40 | 40 | 30 |
| (4) Change of tint | Δ | ○ | ○ | ○ | ○ | ○ | ○ | Δ |

TABLE 3

| Items of evaluation | Example 6 | Example 7 | Example 8 | Example 9 | Example 10 | Example 11 | Example 15 | Example 16 |
|---|---|---|---|---|---|---|---|---|
| (1) Transparency, transmissivity to total rays of incident light (%) | 79.9 | 80.1 | 79.8 | 80.2 | 81.3 | 80.9 | 80.2 | 80.1 |
| (2) Surface property, presence cracks | ○ | ○ | ○ | ○ | ○ | ○ | ○ | ○ |
| (3) Film strength, pencil hardness test | ◎ | ○ | ○ | ○ | ○ | ○ | ◎ | ◎ |
| (4) Finger contact test, presence of tack and finger prints | ○ | ○ | ○ | ○ | ○ | ○ | ○ | ○ |
| (5) Blocking property | ○ | ○ | ○ | ○ | ○ | ○ | ○ | ○ |
| (6) Printing characteristics | | | | | | | | |
| (1) Presence of Image defects | | | | | | | | |
| Feathering | ○ | ◎ | ◎ | ◎ | ○ | ◎ | ◎ | ◎ |
| Bleeding | ○ | ○ | ○ | ○ | ○ | ○ | ◎ | ○ |
| Beading | ◎ | ◎ | ○ | ◎ | ○ | ◎ | ◎ | ◎ |
| Repellency | ○ | ○ | ○ | ○ | ○ | ○ | ○ | ○ |
| Stripy flaws | ◎ | ◎ | ◎ | ◎ | ○ | ◎ | ◎ | ○ |
| (2) Image density | | | | | | | | |
| Bk | 1.98 | 2.00 | 1.95 | 2.02 | 2.00 | 2.01 | 2.01 | 2.00 |
| Y | 1.90 | 1.92 | 1.89 | 2.01 | 1.95 | 1.98 | 1.94 | 1.93 |
| M | 1.91 | 1.93 | 1.87 | 1.99 | 1.94 | 1.97 | 1.93 | 1.93 |
| C | 1.92 | 1.91 | 1.88 | 1.98 | 1.95 | 1.96 | 1.93 | 1.92 |
| (3) Number of gradation stages | 40 | 40 | 40 | 40 | 40 | 40 | 40 | 40 |
| (4) Change of tint | ○ | ○ | ○ | ○ | ○ | ○ | ○ | ○ |

TABLE 4

| | Example 12 | | | | | | | | |
|---|---|---|---|---|---|---|---|---|---|
| Items of evaluatlonf Tg (° C.) | 0 | 10 | 30 | 50 | 70 | 100 | 140 | 150 | 200 |
| (1) Transparency, transmissivity to total rays of incident light (%) | 70.2 | 73.1 | 75.9 | 80.3 | 80.2 | 80.5 | 80.2 | 78.9 | 77.8 |
| (2) Surface property, presence cracks | ○ | ○ | ○ | ○ | ○ | ○ | Δ | Δ | X |
| (3) Film strength, pencil hardness test | Δ | Δ | ○ | ○ | ○ | ○ | ○ | Δ | X |
| (4) Finger contact test, presence of tack and fingerprints | X | Δ | Δ | ○ | ○ | ○ | ○ | ○ | Δ |
| (5) Blocking property | X | Δ | ○ | ○ | ○ | ○ | ○ | ○ | ○ |
| (6) Printing characteristics | | | | | | | | | |
| (1) Presence of Image defects | | | | | | | | | |
| Feathering | X | Δ | ○ | ◎ | ◎ | ◎ | ◎ | ○ | X |
| Bleeding | X | Δ | Δ | ◎ | ◎ | ◎ | ◎ | Δ | X |
| Beading | X | Δ | ○ | ◎ | ◎ | ◎ | ◎ | ○ | ○ |
| Repellency | ○ | ○ | ○ | ○ | ○ | ○ | ○ | ○ | ○ |
| Stripy flaws | Δ | Δ | ○ | ◎ | ◎ | ◎ | ◎ | ○ | ○ |
| (2) Image density | | | | | | | | | |
| Bk | 1.82 | 1.83 | 1.86 | 2.01 | 2.01 | 2.00 | 1.98 | 1.90 | 1.89 |
| Y | 1.76 | 1.76 | 1.82 | 1.95 | 1.94 | 1.95 | 1.95 | 1.82 | 1.78 |
| M | 1.73 | 1.74 | 1.83 | 1.96 | 1.94 | 1.93 | 1.96 | 1.83 | 1.73 |
| C | 1.74 | 1.73 | 1.81 | 1.93 | 1.95 | 1.94 | 1.95 | 1.82 | 1.74 |
| (3) Number of gradation stages | 30 | 30 | 40 | 40 | 40 | 40 | 40 | 40 | 30 |
| (4) Change of tint | X | Δ | Δ | ○ | ○ | ○ | ○ | Δ | Δ |

TABLE 5

| Items of evaluation/ P/B ratio | 0.5:1 | 1:1 | 3:1 | 7:1 | 20:1 | 30:1 | 40:1 |
|---|---|---|---|---|---|---|---|
| (1) Transparency, transmissivity to total to rays of incident light (%) | 81.9 | 78.2 | 80.4 | 80.2 | 80.1 | 75.8 | 72.3 |
| (2) Surface property, presence cracks | ○ | ○ | ○ | ○ | ○ | Δ | Δ |
| (3) Film strength, pencil hardness test | Δ | ○ | ○ | ○ | ○ | Δ | X |
| (4) Finger contact test, Presence of tack and finger prints | Δ | Δ | ○ | ○ | ○ | ○ | ○ |
| (5) Blocking property | Δ | ○ | ○ | ○ | ○ | ○ | ○ |
| (6) Printing characteristics | | | | | | | |
| (1) Presence of Image defects | | | | | | | |
| Feathering | X | Δ | ○ | ◎ | ○ | Δ | X |
| Bleeding | X | Δ | ○ | ◎ | ◎ | ○ | ○ |
| Beading | Δ | Δ | ◎ | ◎ | ◎ | ○ | ○ |
| Repellency | ○ | ○ | ○ | ○ | ○ | ○ | ○ |
| Stripy flaws | Δ | ○ | ◎ | ◎ | ○ | ○ | ○ |
| (2) Image density | | | | | | | |
| Bk | 1.92 | 1.98 | 2.00 | 2.01 | 1.98 | 1.91 | 1.89 |
| Y | 1.90 | 1.93 | 1.94 | 1.94 | 1.90 | 1.88 | 1.85 |
| M | 1.87 | 1.93 | 1.92 | 1.94 | 1.88 | 1.85 | 1.84 |
| C | 1.86 | 1.91 | 1.92 | 1.95 | 1.86 | 1.83 | 1.87 |
| (3) Number of gradation stages | 40 | 40 | 40 | 40 | 40 | 40 | 30 |
| (4) Change of tint | ○ | ○ | ○ | ○ | ○ | Δ | Δ |

TABLE 6

| Items of evaluation/ Alcohol (%) | 10 | 30 | 50 | 70 | 90 | 98 |
|---|---|---|---|---|---|---|
| (1) Transparency, transmissivity to total rays of incident light (%) | 68.5 | 75.6 | 78.7 | 80.2 | 80.5 | 80.8 |
| (2) Surface property, presence cracks | Δ | ○ | ○ | ○ | ○ | Δ |
| (3) Film strength, pencil hardness test | X | ○ | ○ | ○ | ○ | ○ |
| (4) Finger contact test, Presence of tack and finger prints | Δ | ○ | ○ | ○ | ○ | Δ |
| (5) Blocking property | Δ | ○ | ○ | ○ | ○ | Δ |
| (6) Printing characteristics | | | | | | |
| (1) Presence of image defects | | | | | | |
| Feathering | Δ | ○ | ○ | ◎ | ○ | Δ |
| Bleeding | X | Δ | ○ | ◎ | ○ | X |
| Beading | Δ | ○ | ○ | ◎ | ○ | Δ |
| Repellency | ○ | ○ | ○ | ○ | ○ | Δ |
| Stripy flaws | ○ | ○ | ○ | ◎ | ◎ | ○ |
| (2) Image density | | | | | | |
| Bk | 1.75 | 1.89 | 1.99 | 2.01 | 2.00 | 1.89 |
| Y | 1.72 | 1.82 | 1.89 | 1.94 | 1.92 | 1.85 |
| M | 1.70 | 1.81 | 1.85 | 1.94 | 1.91 | 1.84 |
| C | 1.71 | 1.80 | 1.86 | 1.95 | 1.91 | 1.85 |
| (3) Number of gradation stages | 30 | 40 | 40 | 40 | 40 | 40 |
| (4) Change of tint | Δ | ○ | ○ | ○ | ○ | Δ |

TABLE 7

| Items of evaluation | Example 17 | Example 18 | Example 19 | Example 20 | Example 21 |
|---|---|---|---|---|---|
| (1) Transparency, transmissivity to total rays of incident light (%) | 80.0 | 82.4 | 80.6 | 80.2 | 80.1 |
| (2) Surface property, presence cracks | ○ | ○ | ○ | ○ | ○ |
| (3) Film strength, pencil hardness test | ○ | ○ | ○ | ◎ | ○ |
| (4) Finger contact test, presence of tack and finger prints | ○ | ○ | ○ | ○ | ○ |
| (5) Blocking property | ○ | ○ | ○ | ○ | ○ |
| (6) Printing characteristics | | | | | |
| (1) Presence of image defects | | | | | |
| Feathering | ◎ | ◎ | ◎ | ◎ | ◎ |
| Bleeding | ◎ | ○ | ○ | ○ | ◎ |
| Beading | ◎ | ○ | ◎ | ○ | ◎ |
| Repellency | ○ | ○ | ○ | ○ | ○ |
| Stripy flaws | ◎ | ○ | ◎ | ○ | ◎ |
| (2) Image density | | | | | |
| Bk | 2.02 | 2.01 | 2.01 | 2.00 | 2.01 |
| Y | 1.95 | 1.93 | 1.94 | 1.91 | 1.94 |
| M | 1.95 | 1.92 | 1.95 | 1.90 | 1.93 |
| C | 1.94 | 1.92 | 1.94 | 1.91 | 1.94 |
| (3) Number of gradation stages | 40 | 40 | 40 | 40 | 40 |
| (4) Change of tint | ○ | ○ | ○ | ○ | ○ |

TABLE 8

| Items of evaluation | Example 22 | Example 23 | Example 24 |
|---|---|---|---|
| (6) Printing characteristics | | | |
| (1) Presence of image defects | | | |
| Feathering | ◎ | ◎ | ◎ |
| Bleeding | ◎ | ○ | ○ |
| Beading | ◎ | ◎ | ◎ |
| Repellency | ○ | ○ | ○ |
| Stripy flaws | ○ | ○ | ◎ |
| (2) Image density | | | |
| Bk | 2.15 | 2.15 | 2.13 |
| Y | 2.01 | 1.94 | 1.99 |
| M | 2.03 | 1.94 | 1.98 |
| C | 2.04 | 1.95 | 2.00 |
| (3) Number of gradation stages | 40 | 40 | 40 |
| (4) Change of tint | ○ | ○ | ○ |
| (7) Fixing effect of colorants | ○ | ○ | ○ |
| (8) Glossiness of printing section | ○ | ○ | ○ |

What is claimed is:

1. A recording medium comprising a base material layer, a porous lower layer containing hydrated alumina showing a boehmite structure and a binder, said porous lower layer having a pore volume per unit area of not less than 8 cc/m$^2$, and a porous upper layer provided on the porous lower layer, said porous upper layer being formed from a binder of thermoplastic resin emulsion, and containing agglomerates with voids therebetween, the agglomerates comprising spherical silica particles and the binder, the spherical silica particles having a primary particle diameter of 1–100 nm, wherein the surface of the porous upper layer constitutes an outer surface of the recording medium, and the surface is more dense than the inside thereof.

2. A recording medium according to claim 1, wherein said spherical silica particles have a diametrical distribution showing two peaks, one of which exists between 10 and 100 nm and the other exists between 1 and 10 nm.

3. A recording medium according to claim 1, wherein said spherical silica particles include those with a diameter between 10 and 100 nm and those with a diameter between 1 and 10 nm.

4. A recording medium according to claim 3, wherein the spherical silica particles with a diameter between 1 and 10 nm are substantially found within said agglomerates, whereas the spherical silica particles with a diameter between 10 and 100 nm are found outside said agglomerates.

5. A recording medium according to claim 1, wherein the maximum peak of pore radius distribution of said porous upper layer is between 10 and 20 nm.

6. A recording medium according to claim 1, wherein the maximum peak of pore radius distribution of said porous upper layer is between 20 and 200 nm.

7. A recording medium according to claim 1, wherein the maximum peak of pore radius distribution of said porous upper layer and said porous lower layer, when taken together, is between 2.0 and 20 nm.

8. A recording medium according to claim 1, wherein the volume of the pores of said porous lower layer and said porous upper layer, when taken together, is between 0.4 and 1.5 ml/g.

9. An image forming method comprising the step of applying ink to a recording medium according to any of claims 1 through 8.

10. An image forming method according to claim 9, wherein an ink-jet system is used for applying ink.

11. An image forming method according to claim 10, wherein said ink-jet system is a system for ejecting ink droplets by applying thermal energy to the ink.

12. An image forming method according to claim 11, wherein said system for ejecting ink droplets is a printing system using three or more than three different types of ink with different colorant densities.

13. An image forming method according to claim 11, wherein said system for ejecting ink droplets is a printing system using ink containing one or more than one pigments as colorants.

14. An image forming method according to claim 11, wherein said system for ejecting ink droplets is a printing system using ink obtained by combining ink containing a pigment and ink containing a dye.

15. An image forming method according to claim 11, wherein said system for ejecting ink droplets is a printing system using a plurality of inks with different color tones.

16. The recording medium according to claim 1, wherein the spherical silica particles are colloidal silica particles.

17. The recording medium according to claim 1, wherein the resin emulsion has a glass transition temperature of 10–150° C., and a particle diameter of 0.03–0.5 $\mu$m.

18. A method of manufacturing a recording medium comprising steps of sequentially laying a porous lower layer containing hydrated alumina showing a boehmite structure and a binder, and a porous upper layer containing agglomerates with voids therebetween, the agglomerates comprising spherical silica particles on a base material layer, wherein said porous upper layer is formed by applying and drying a dispersive solution prepared by adding alcohol by 30 to 90% to an aqueous dispersive solution comprising spherical colloidal silica with an average particle diameter between 1 and 100 nm and a binder of thermoplastic resin emulsion, wherein said porous lower layer has a pore volume per unit area of not less than 8 cc/m$^2$.

19. A method of manufacturing a recording medium according to claim 18, wherein said spherical colloidal silica has at least two peaks of particle diameter distribution.

20. A method of manufacturing a recording medium according to claim 18, wherein said spherical colloidal silica has at least two peaks of particle diameter distribution including one within a range between 10 and 100 nm and one within a range between 1 and 10 nm.

21. A method of manufacturing a recording medium according to claim 18, wherein said spherical colloidal silica is acidic colloidal silica.

22. A method of manufacturing a recording medium according to claim 18, wherein the glass transition temperature of said resin emulsion is within a range between 10 and 150° C.

23. A method of manufacturing a recording medium according to claim 18, wherein the average diameter of said dispersed particles is within 0.03 and 0.05 $\mu$m.

24. A method of manufacturing a recording medium according to claim 18, wherein the applied solution is dried at a temperature above the glass transition temperature of said resin emulsion when forming said porous upper layer.

25. A method of manufacturing a recording medium according to claim 18, wherein said solution to be applied to produce said porous upper layer contains a coupling agent.

26. A method of manufacturing a recording medium according to claim 25, wherein said coupling agent is selected from silane, titanate, aluminum and zirconia coupling agents.

* * * * *

UNITED STATES PATENT AND TRADEMARK OFFICE

CERTIFICATE OF CORRECTION

PATENT NO. : 6,685,999 B2
DATED : February 3, 2004
INVENTOR(S) : Hirofumi Ichinose et al.

It is certified that error appears in the above-identified patent and that said Letters Patent is hereby corrected as shown below:

Column 3,
Line 57, “improve” should read -- improves --.

Column 4,
Line 21, “due of” should read -- due to --.

Column 5,
Line 12, “to-the” should read -- to the --.

Column 18,
Line 52, “those the” should read -- those of the --.

Column 19,
Line 11, “from in” should read -- from --.

Column 23,
Line 39, “referred as” should read -- referred to as --.
Line 57, “1 portions” should read -- 1 portion --.
Line 61, “0.6 portions’ should read -- 0.6 portion --.

Column 24,
Line 5, “ranging 100%” should read -- ranging from 100% --.

Column 25,
Line 40, “invention.” should read -- to find a void structure specific to the present invention. --

Column 26,
Line 39, “emulsion.” should read -- emulsion were used. --.

Column 28,
Line 5, “radiuss” should read -- radius --.

Column 29,
Line 16, “radiuss” should read -- radius --.
Line 54, “dissolved” should read -- dissolved --.

Column 34,
Line 29, “larges” should read -- large --.

UNITED STATES PATENT AND TRADEMARK OFFICE

CERTIFICATE OF CORRECTION

PATENT NO. : 6,685,999 B2
DATED : February 3, 2004
INVENTOR(S) : Hirofumi Ichinose et al.

It is certified that error appears in the above-identified patent and that said Letters Patent is hereby corrected as shown below:

Column 35,
Line 7, “8.23” should read -- 82.3 --.
Line 12, “presence cracks” should read -- presence of cracks --.

Column 37,
Line 45, “fingerprints” should read -- finger prints --.

Column 39,
Line 8, “total to rays” should read -- total rays --.

Column 42,
Line 19, “pigments” should read -- pigment --.

Signed and Sealed this

Twenty-ninth Day of June, 2004

JON W. DUDAS
*Acting Director of the United States Patent and Trademark Office*